US011548727B2

(12) United States Patent
Boyea

(10) Patent No.: US 11,548,727 B2
(45) Date of Patent: Jan. 10, 2023

(54) TRANSFORMATIVE EXTENDER AND METHOD THEREOF

(71) Applicant: Christopher E. Boyea, Burnt Hills, NY (US)

(72) Inventor: Christopher E. Boyea, Burnt Hills, NY (US)

( * ) Notice: Subject to any disclaimer, the term of this patent is extended or adjusted under 35 U.S.C. 154(b) by 428 days.

(21) Appl. No.: 16/037,731

(22) Filed: Jul. 17, 2018

(65) Prior Publication Data

US 2020/0024072 A1 Jan. 23, 2020

(51) Int. Cl.

| | |
|---|---|
| ***B65F 1/08*** | (2006.01) |
| ***B65D 5/06*** | (2006.01) |
| ***B65D 5/02*** | (2006.01) |
| ***B65F 1/04*** | (2006.01) |
| ***B65D 21/08*** | (2006.01) |
| *B65D 5/04* | (2006.01) |

(52) U.S. Cl.

CPC ..... *B65F 1/08* (2013.01); *B65D 5/029* (2013.01); *B65D 5/061* (2013.01); *B65D 21/083* (2013.01); *B65F 1/04* (2013.01); *B65D 5/04* (2013.01)

(58) Field of Classification Search

CPC . B65F 1/10; B65F 1/04; B65D 21/083; B65D 5/029; B65D 5/04; B65D 5/061; B65D 11/186; B65D 2519/0092

USPC .... 220/908.3, 4.03; 229/112, 113, 126, 907, 229/117

See application file for complete search history.

(56) References Cited

U.S. PATENT DOCUMENTS

| | | | | |
|---|---|---|---|---|
| 385,726 | A * | 7/1888 | Reynolds | 229/125.17 |
| 1,238,090 | A | 8/1911 | Beringer | |
| 1,666,294 | A | 4/1928 | Downes-Martin | |
| 1,724,743 | A | 8/1929 | Allen | |
| 1,858,793 | A | 5/1932 | Reynolds | |

(Continued)

FOREIGN PATENT DOCUMENTS

| | | |
|---|---|---|
| JP | 2012140217 | 7/2012 |
| KR | 2020110006981 | 2/2013 |
| WO | 2013150307 | 10/2013 |

OTHER PUBLICATIONS

Office Action (dated Jan. 12, 2016) for U.S. Appl. No. 14/818,175, filed Aug. 4, 2015.

(Continued)

*Primary Examiner* — James N Smalley
*Assistant Examiner* — Jennifer Castriotta
(74) *Attorney, Agent, or Firm* — Schmeiser, Olsen & Watts, LLP

(57) ABSTRACT

An embodiment of a box is configured to be transformed to include a tapered structure configured such that when the transformed box is inserted into the receptacle, the tapered structure provides a universal fit. An embodiment of an extender is formed by steps including providing a single piece of material having a first edge and a second edge and forming, by cutting the single piece of material, at least one top extension extending from at least one wall and at least one bottom extension extending from the at least one wall such that the at least one top extension is foldable to abut the at least one wall. A method for collecting waste materials includes providing a receptacle and a box, and disrupting the extender. An embodiment of an extender comprises a first wall, a second wall, a third wall, and a fourth wall.

19 Claims, 24 Drawing Sheets

(56) References Cited

U.S. PATENT DOCUMENTS

| | | | | |
|---|---|---|---|---|
| 2,107,995 | A | 2/1938 | Statham | |
| 2,429,958 | A | 10/1947 | Liebmann | |
| 2,572,610 | A | 10/1951 | Gilbert | |
| 2,927,377 | A | 3/1960 | Lewis | |
| 3,119,494 | A | 1/1964 | Rosenstiel | |
| 3,455,498 | A * | 7/1969 | Gadiel | B65D 5/10 229/117 |
| 3,525,962 | A | 8/1970 | Javorik | |
| 3,539,091 | A | 11/1970 | Murray | |
| 3,785,534 | A * | 1/1974 | Smith | B65D 77/062 222/460 |
| 3,944,130 | A * | 3/1976 | Smith | B65D 5/029 229/114 |
| 4,161,252 | A | 7/1979 | Howells | |
| 4,280,676 | A | 7/1981 | Betts | |
| 4,628,007 | A | 12/1986 | Ledsham | |
| 4,852,757 | A | 8/1989 | Milton | |
| 4,860,910 | A | 8/1989 | Zipper | |
| 4,932,930 | A * | 6/1990 | Coalier | B31B 50/00 493/128 |
| 4,940,138 | A | 7/1990 | Hornstein | |
| 4,974,737 | A | 12/1990 | Miller | |
| 4,976,737 | A | 12/1990 | Leake | |
| 4,979,547 | A | 12/1990 | Hoerner | |
| 5,022,548 | A | 6/1991 | Stakis | |
| D318,163 | S | 7/1991 | Chalmers | |
| 5,035,563 | A | 7/1991 | Mezey | |
| D318,896 | S | 8/1991 | Starkweather | |
| 5,048,778 | A | 9/1991 | Wright | |
| 5,147,271 | A * | 9/1992 | Bacques | B65D 5/02 493/176 |
| 5,271,589 | A | 12/1993 | Belous | |
| 5,400,955 | A * | 3/1995 | Coalier | B65D 5/008 229/103.3 |
| 5,417,338 | A | 5/1995 | Roy et al. | |
| 5,445,397 | A | 8/1995 | Evans | |
| 5,598,942 | A | 2/1997 | Cowie | |
| 5,642,828 | A | 7/1997 | Sorens | |
| 5,704,541 | A * | 1/1998 | Mogard | B65D 5/746 229/125.15 |
| 5,765,614 | A | 6/1998 | Kardosh et al. | |
| 5,897,084 | A | 4/1999 | Judge | |
| 5,915,768 | A | 6/1999 | Young | |
| 6,062,415 | A | 5/2000 | Harper | |
| 6,131,759 | A | 10/2000 | Young | |
| 6,135,518 | A | 10/2000 | Holthaus | |
| 6,581,796 | B1 | 6/2003 | Pilkinton | |
| 6,938,860 | B2 | 9/2005 | Singleton | |
| 7,077,283 | B2 | 7/2006 | Yang et al. | |
| 7,192,037 | B1 | 3/2007 | Pena | |
| 7,219,705 | B2 | 5/2007 | Wallek | |
| 7,302,978 | B1 | 12/2007 | Kolarik | |
| 7,562,784 | B2 | 7/2009 | Stevenson | |
| 7,789,238 | B2 | 9/2010 | Claypool | |
| 7,866,538 | B2 | 1/2011 | Liao | |
| D633,268 | S | 2/2011 | Bottita | |
| 7,984,733 | B2 | 7/2011 | Noonan | |
| 8,479,780 | B2 | 7/2013 | Fernandez et al. | |
| 8,757,563 | B2 | 6/2014 | Muse | |
| 9,771,184 | B2 | 9/2017 | Arcot | |
| 9,783,362 | B2 | 10/2017 | Boyea | |
| 2004/0089657 | A1 | 5/2004 | Waszak | |
| 2006/0144467 | A1 | 7/2006 | Butzer | |
| 2007/0158345 | A1 | 7/2007 | Booth et al. | |
| 2008/0029658 | A1 | 2/2008 | Vanbost | |
| 2008/0251526 | A1 | 10/2008 | Fick | |
| 2010/0089916 | A1 | 4/2010 | Fielden | |
| 2010/0108826 | A1 | 5/2010 | Fernandez | |
| 2011/0309208 | A1 * | 12/2011 | Muse | B65B 67/1238 248/97 |
| 2011/0309209 | A1 | 12/2011 | Muse | |
| 2012/0012228 | A1 | 1/2012 | Karabas | |
| 2012/0248118 | A1 | 10/2012 | Perkowski | |
| 2015/0014310 | A1 | 1/2015 | Liu et al. | |
| 2015/0069054 | A1 | 3/2015 | Nolan et al. | |
| 2015/0375558 | A1 | 12/2015 | Ben-Or | |
| 2016/0031641 | A1 | 2/2016 | Boyea | |
| 2016/0137334 | A1 * | 5/2016 | Garland | B65D 5/10 229/113 |
| 2016/0145041 | A1 | 5/2016 | Fritch | |
| 2017/0210558 | A1 | 7/2017 | Boyea | |
| 2017/0341859 | A1 | 11/2017 | Boyea | |
| 2018/0086492 | A1 | 3/2018 | Weathers | |
| 2018/0093826 | A1 | 4/2018 | Boyea | |

OTHER PUBLICATIONS

Office Action (dated Sep. 14, 2016) for U.S. Appl. No. 14/818,175, filed Aug. 4, 2015.
Advisory Action (dated Jan. 10, 2017) for U.S. Appl. No. 14/818,175, filed Aug. 4, 2015.
Office Action (dated Mar. 13, 2017) for U.S. Appl. No. 14/818,175, filed Aug. 4, 2015.
Notice of Allowance (dated Jun. 16, 2017) for U.S. Appl. No. 14/818,175, filed Aug. 4, 2015.
Issue Notification (dated Sep. 20, 2017) for U.S. Appl. No. 14/818,175, filed Aug. 4, 2015.
Office Action (dated Jan. 11, 2018) for U.S. Appl. No. 15/480,723, filed Apr. 6, 2017.
Office Action (dated Jun. 6, 2017) for U.S. Appl. No. 15/480,723, filed Apr. 6, 2017.
Office Action (dated Aug. 25, 2017) for U.S. Appl. No. 15/672,503, filed Aug. 9, 2017.
Office Action (dated Jun. 6, 2018) for U.S. Appl. No. 15/672,503, filed Aug. 9, 2017.
Office Action (dated Feb. 8, 2019) for U.S. Appl. No. 15/672,503, filed Aug. 9, 2017.
Office Action (dated Jan. 26, 2018) for U.S. Appl. No. 15/831,600)—filed Dec. 5, 2017.
Office Action (dated Sep. 7, 2018) for U.S. Appl. No. 15/831,600)—filed Dec. 5, 2017.
Office Action (dated Dec. 13, 2018) for U.S. Appl. No. 15/831,600)—filed Dec. 5, 2017.
Office Action (dated Mar. 7, 2019) for U.S. Appl. No. 15/982,807)—filed May 17, 2018.
Office Action (dated Sep. 28, 2018) for U.S. Appl. No. 15/982,807)—filed May 17, 2018.

* cited by examiner

TRANSFORMATIVE EXTENDER AND METHOD THEREOF

FIELD OF TECHNOLOGY

The following relates to waste management disposal and containment, and more specifically to embodiments of a device that can increase the capacity of a standard receptacle, while also making garbage collection more efficient.

BACKGROUND

Receptacles, such as garbage cans, typically come in standard sizes. In some households, the standard capacity of the garbage is exceeded before the garbage pickup is scheduled to come. This is especially true when a household hosts a party or an event that results in a larger than normal amount of garbage. The current solution is to stack the garbage next to the garbage can, or purchase an additional garbage can. Stacking the garbage next to the garbage perpetuates an odorous environment, is aesthetically unappealing, and adds labor time for the garbage collectors. Purchasing an additional garbage takes up extra space, can lead to additional charges from a garbage collection company, and may not be compatible with automated garbage trucks.

Additionally, it is often the case that a person needs to store temporarily or permanently, personal, household, or other objects, especially when moving between living areas. A person often needs to dispose of objects from their home or office or other location. However, obtaining multiple containers for storing and disposing of objects and materials can be costly and take up space.

Thus, a need exists for an apparatus and method for increasing a capacity of a receptacle, storing an additional amount of garbage, containing and disposing of objects with a single apparatus, and a method of disposal.

SUMMARY

A first aspect relates generally to a box configured to be transformed to include a tapered structure configured such that when the transformed box is inserted into the receptacle, the tapered structure provides a universal fit.

A second aspect relates generally to an apparatus comprising a first plurality of walls, wherein the first plurality of straight walls defines an interior space between the first plurality of walls; and a second plurality of walls adjacent to the first plurality of walls, the second plurality of walls forming a tapered section of the apparatus that extends inwardly with respect to the first plurality of walls.

A third aspect relates generally to a method for collecting waste materials, the method comprising providing a receptacle for storing waste materials; providing a box configured to be transformed to include a tapered structure configured such that when the transformed box is inserted into the receptacle, the tapered structure provides a universal fit; and disrupting the receptacle such that the transformed box disengages with the receptacle and exits the receptacle.

A fourth aspect relates generally to an extender for a waste receptacle comprising a first wall comprising a first top edge, a first bottom edge, a first side edge, and a second side edge; a second wall comprising a second top edge, a second bottom edge, a third side edge, and a fourth side edge; a third wall comprising a third top edge, a third bottom edge, a fifth side edge, and a sixth side edge; a fourth wall comprising a fourth top edge, a fourth bottom edge, a seventh side edge, and a eighth side edge; wherein the first side edge abuts the eighth side edge to form a first corner; wherein the second side edge abuts the third side edge to form a second corner; wherein the fourth side edge abuts the fifth side edge to form a third corner; wherein the sixth side edge abuts the seventh side edge to form a fourth corner; a first top extension extending from the first top edge; wherein a width of the first top extension extends between the first corner and the second corner; a second top extension extending from the second top edge; wherein a width of the second top extension extends between the second corner and the third corner; a third top extension extending from the third top edge; wherein a width of the third top extension extends between the third corner and the fourth corner; a fourth top extension extending from the fourth top edge; wherein a width of the fourth top extension extends between the fourth corner and the first corner; a first bottom extension extending from the first bottom edge to a first bottom extension edge; wherein the first bottom extension has a first taper extending from the first bottom edge proximate to the first corner to the first bottom extension edge and a second taper extending from the first bottom edge proximate to the second corner to the first bottom extension edge such that a width of the first bottom extension edge is less than a width of the first bottom edge; a second bottom extension extending from the second bottom edge to a second bottom extension edge; wherein the second bottom extension has a third taper extending from the second bottom edge proximate to the second corner to the second bottom extension edge and a fourth taper extending from the second bottom edge proximate to the third corner to the second bottom extension edge such that a width of the second bottom extension edge is less than a width of the second bottom edge; a third bottom extension extending from the third bottom edge to a third bottom extension edge; wherein the third bottom extension has a fifth taper extending from the third bottom edge proximate to the third corner to the third bottom extension edge and a sixth taper extending from the third bottom edge proximate to the fourth corner to the third bottom extension edge such that a width of the third bottom extension edge is less than a width of the third bottom edge; a fourth bottom extension extending from the fourth bottom edge to a fourth bottom extension edge; wherein the fourth bottom extension has a seventh taper extending from the fourth bottom edge proximate to the fourth corner to the fourth bottom extension edge and a eighth taper extending from the fourth bottom edge proximate to the first corner to the fourth bottom extension edge such that a width of the fourth bottom extension edge is less than a width of the fourth bottom edge; wherein the first wall, the second wall, the third wall, and the fourth wall define an interior space; wherein the first top extension is folded about the first top edge into the interior space such that the first top extension is parallel to and abuts the first wall; wherein the second top extension is folded about the second top edge into the interior space such that the second top extension is parallel to and abuts the second wall; wherein the third top extension is folded about the third top edge into the interior space such that the third top extension is parallel to and abuts the third wall; and wherein the fourth top extension is folded about the fourth top edge into the interior space such that the fourth top extension is parallel to and abuts the fourth wall.

A fourth aspect relates generally to an extender prepared by the steps of providing a single piece of material having a first edge and a second edge; forming, by cutting the single piece of material, at least one top extension extending from at least one wall and at least one bottom extension extending from the at least one wall such that the at least one top extension is foldable to abut the at least one wall; forming, by cutting the at least one bottom extension, a taper in the at least one bottom extension; wherein the at least one bottom extension is configured to create a taper in a portion of the interior space when the extender is inserted into a waste receptacle; and attaching the first edge and the second edge together such that the single piece of material defines an interior space.

A fifth aspect relates generally to a method comprising cutting a single piece of material to form at least one top extension extending from at least one wall and at least one bottom extension extending from the at least one wall such that the at least one top extension is foldable to abut the at least one wall, cutting the at least one bottom extension to create a taper in the at least one bottom extension, wherein the at least one bottom extension is configured to create a taper in a portion of the interior space when the extender is inserted into a waste receptacle, and attaching the first edge and the second edge together such that the single piece of material defines an interior space.

The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms “a”, “an” and “the” include plural referents, unless the context clearly dictates otherwise.

Figure 1:
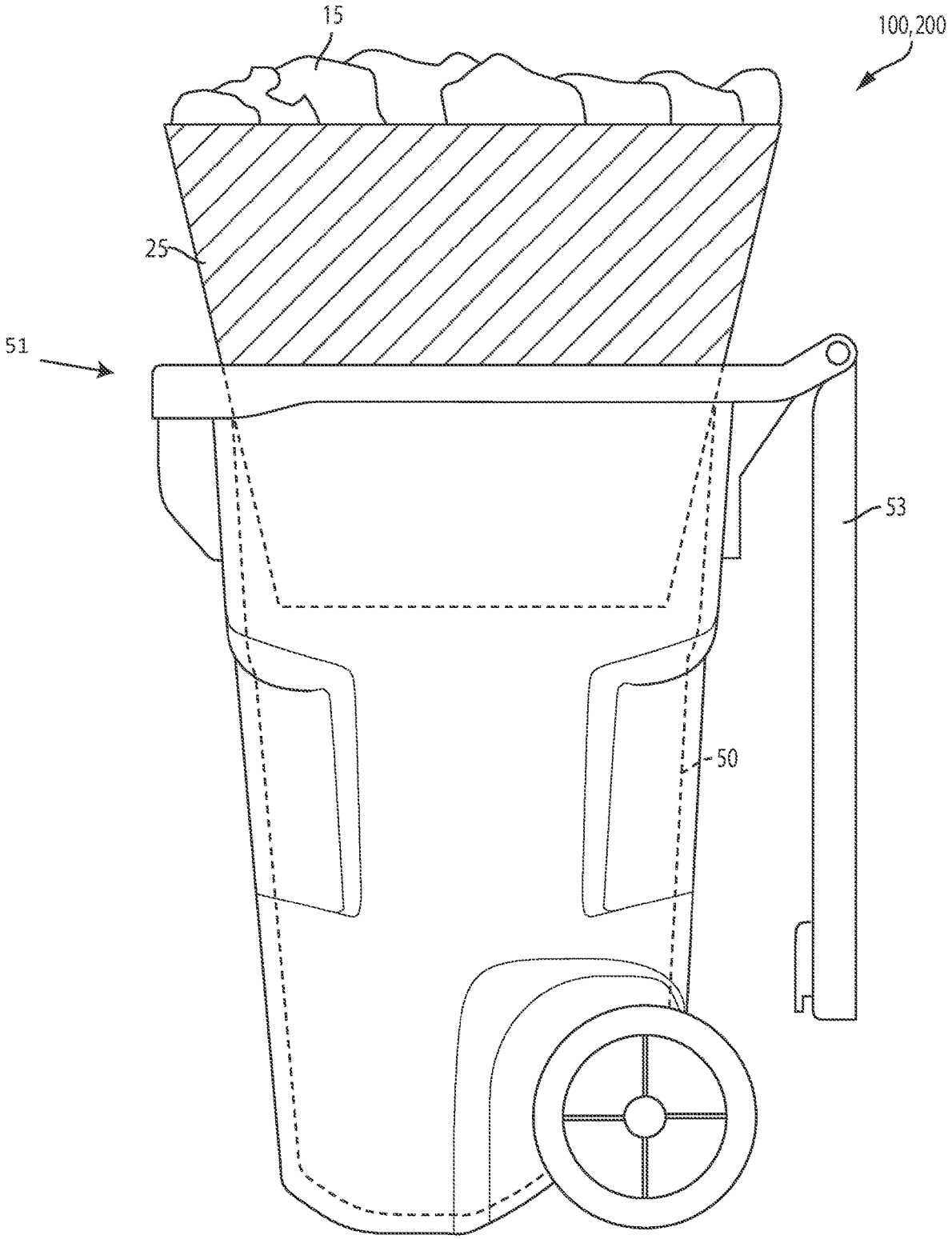
FIG. 1 depicts a schematic view of a first embodiment of an extender located within an embodiment of a receptacle.

Referring to the drawings, FIG. 1 depicts an embodiment of an extender 100, 200 operably engaged with a receptacle 50. The extender 100, 200 may be a device that may be configured to be placed at least partially within a receptacle 50, such as industry standard sized garbage can, to extend or otherwise increase a capacity of the receptacle 50. The increased capacity, labeled as increased capacity 25 in FIG. 1, is an amount of volume for storing garbage, waste, yard waste, leaves, etc., or any contents suitable for placement in a receptacle that is in addition to a maximum volume afforded by the receptacle 50. For example, if the receptacle 50 becomes full of waste materials 15, such as garbage, waste, recyclables, yard waste, and the like, any additional waste materials will not fit properly within the receptacle 50, and likely fall to the side of the receptacle 50, or can blow away due to the wind or other environmental elements. To increase a volume or storage capacity of the receptacle 50, embodiments of an extender 100, 200 may be placed at least partially within the receptacle 50 so that additional waste materials 15 may be added to the waste material already within the receptacle 50. While the extender 100, 200 is operatively attached to the receptacle 50, a storage capacity of the receptacle 50 is effectively increased because of the walls of the extender 100 extending beyond a top end 51 of the receptacle 50. Embodiments of the receptacle 50 may be a garbage can, a pail, a garbage pail, a transportable waste container, a waste collection device, a barrel, a bucket, and the like. Embodiments of the receptacle 50 may be an industrial garbage can, and may be compatible with automatic garbage truck loaders, for example, receptacles provided by waste collection companies for scheduled pickup. In some embodiments, the receptacle 50 may include a cover 53 that can be hingedly or otherwise pivotally attached to the receptacle 50. Further, embodiments of receptacle 50 may be various sizes, as might be offered/provided by a waste collection company or a municipality, or otherwise available for purchase at a home improvement store.

Figure 2:
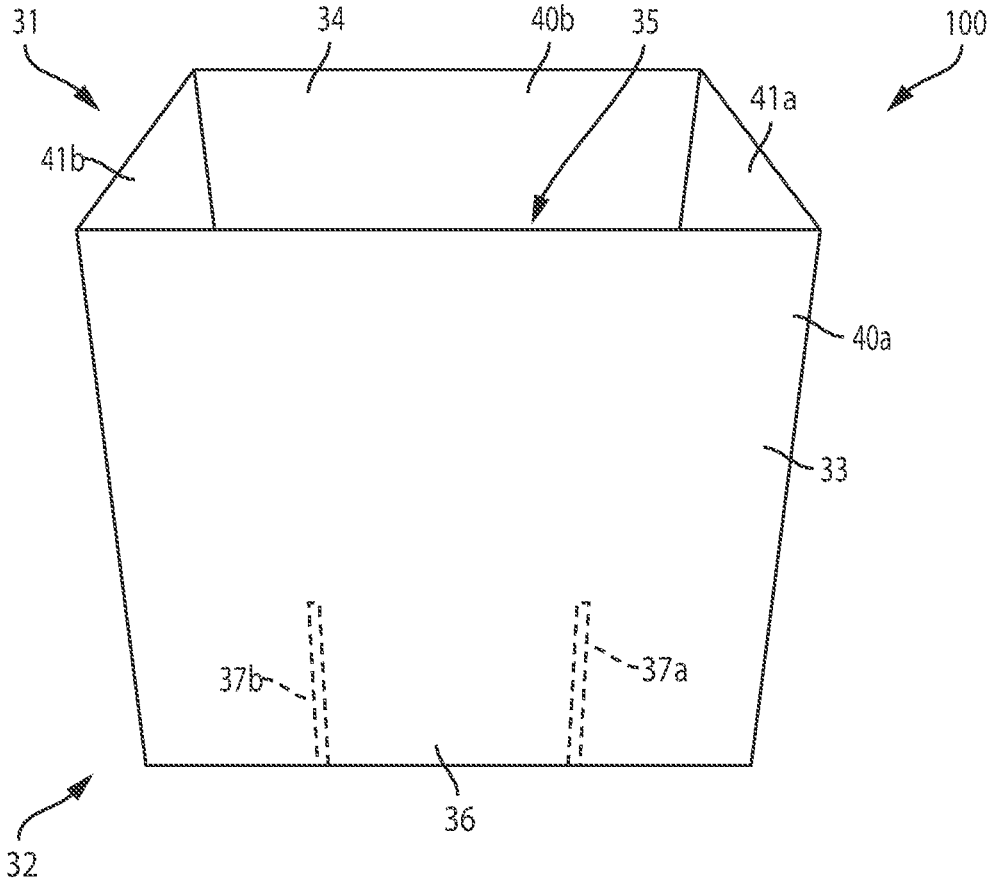
FIG. 2 depicts a perspective view of the first embodiment of an extender.

With continued reference to FIG. 1, an embodiment of extender 100 is depicted in FIG. 2. Embodiments of extender 100 may be an insert, a tapered box, a tapered structure, a garbage containment unit, a cardboard insert, or the like, sized and dimensioned to be placed within a receptacle 50 of various sizes. Embodiments of extender 100 may include a first end 31, a second end 32, an outer surface 33, an inner surface 34, and a general opening extending therethrough. Embodiments of extender 100 may be cone-shaped, and may be comprised of a single wall. Embodiments of the extender 100 may be tapered. For instance, embodiments of the extender 100 may taper in a direction from the first end 31 toward a second end 32, such that a width of the extender 100 may gradually decrease from the first end 31 to the second end 32. A tapered structure or configuration of the extender 100 may ensure or promote a friction fit with the receptacle 50 as the extender 100 is lowered or otherwise placed within an interior of the receptacle 50. The tapered configuration may also accommodate various sizes of an interior of various receptacles 50. Further embodiments of the extender 100 may include a tapered section proximate or otherwise near the second end 32, wherein a portion of the extender 100 (e.g. proximate or otherwise near the first end 31) is not tapered, and only begins to taper at a point proximate or otherwise near the second end 32.

Moreover, embodiments of the extender 100 may include a plurality of walls 40*a*, 40*b*, 41*a*, 41*b*. The plurality of walls 40*a*, 40*b*, 41*a*, 41*b* may form or otherwise define an interior space 35 of the extender 100. Each of the plurality of walls 40*a*, 40*b*, 41*a*, 41*b* may be shaped like a trapezoid to facilitate the tapered shape/configuration of the extender 100. A number and an arrangement of the plurality of walls, when operably configured, may correspond to a geometric shape of an opening of the receptacle 50 so that it may at least partially fit within the receptacle 50. In one embodiment, the extender 100 may include four walls, with a front wall 40*a*, a back wall 40*b*, a first side wall 41*a*, and a second side wall 41*b*. The walls 40*a*, 40*b*, 41*a*, 41*b* may be equal in size, or may vary in size with respect to each other. Furthermore, the walls 40*a*, 40*b*, 41*a*, 41*b* may be structurally integral with each other and joined along each edge to the next wall, as shown in FIG. 2. The edges may be creased or pre-creased to facilitate or promote flexibility of the extender 100. The flexibility of the extender 100 may vary, but in some cases, the extender 100 may be able to be folded into a flat unit, while all of the edges of the walls 40*a*, 40*b*, 41, 41*b* remain connected, structurally integral or otherwise.

Figure 3:
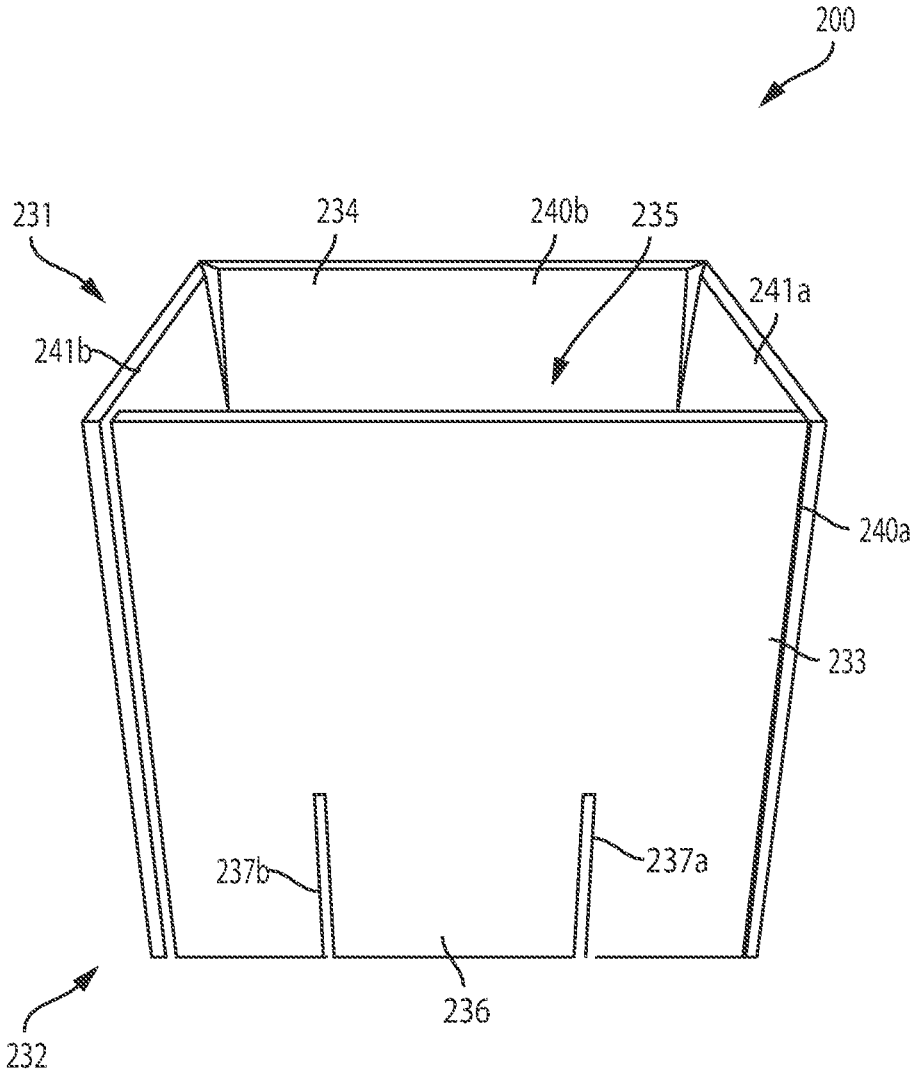
FIG. 3 depicts a perspective view of a second embodiment of an extender.
Figure 4:
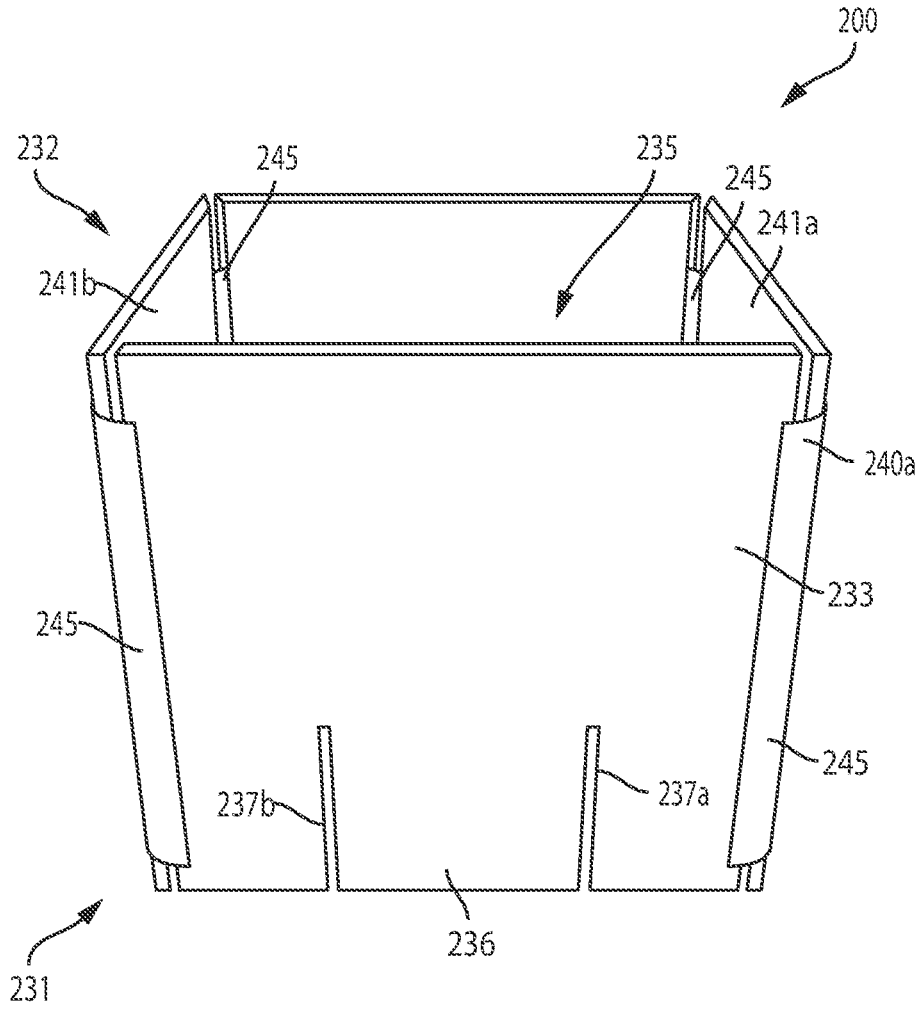
FIG. 4 depicts a perspective view of the second embodiment of an extender with an embodiment of a connection element.

FIG. 3 depicts an embodiment of extender 200. Embodiments of extender 200 may share the same or substantially the same structural and functional aspects of extender 100, including a first end 231, a second end 232, an outer surface 233, and inner surface 234, a general opening therethrough, and an interior space 235. However, extender 200 may include at least one edge of one of the plurality of walls 240*a*, 240*b*, 241*a*, 241*b* may be a free edge, which may also allow the extender 200 to be packaged and sold as a flat, or relatively flat, or a folded flat unit. For example, a left edge of front wall 240*a* may be a free edge, while the other, right, edge of the front wall 240*a* is connected to the left edge of first side wall 241*a*. In this example, an edge of the second side wall 41*b* may also be a free edge. Any configuration or combination of free edges may be implemented to form extender 200. In some operable configurations, such as shown in FIG. 4, the free edges may be connected to each other for added stability once ready for use. For instance, the free edges may be connected to each other using a connection element 245. Embodiments of connection element 245 may be an adhesive tape, such as duct tape, staples, glue, clap, or other suitable material or component that may join two edges of the walls 240*a*, 240*b*, 241*a*, 241*b* together. In other operable configurations, the free edges may remain unconnected when placed within the receptacle 50, wherein the free edges are proximate or otherwise near each other when in this operable configuration.

With continued reference to FIGS. 2-4, embodiments of extender 100, 200 may also include a deflection flap 36, 236. Embodiments of deflection flap 36, 236 may be a section of the extender 100, 200 of one or more walls of extender 100, 200 that may deflect inward or outward to accommodate various sizes of receptacle 50. The deflection, inward or outward, may further promote or otherwise ensure a friction fit between an inner surface of the receptacle 50 and the extender 100, 200. For example, receptacle 50 may have various interior shapes (e.g. protrusions, etc.) that may engage portions of the extender 100, 200 with a different force than another area of the extender 100, 200. The deflection flap or deflection portion 36, 236 may deflect or otherwise move inwardly or outwardly to increase a mechanical interference or friction fit between the receptacle 50 and the extender 100, 200 to compensate for looser connections between the receptacle 50 and the extender 100, 200 in other areas. The deflection of the flap 36, 236 may also be affected by waste materials already within receptacle 50, which may also promote friction fit between the extender 100, 200 and the receptacle 50. Embodiments of the deflection flap 36, 236 may be formed by one or more vertical slits 237*a*, 237*b* extending from a second end 32, 232 of the extender 100, 200 a distance towards the first end 32, 232. The vertical slits may permit deflection inwardly or outwardly, as described above. The vertical slits 237*a*, 237*b* may be perforations, or may be a continuous cut into the extender 100, 200. Furthermore, embodiments of the extender 100, 200 may be made out of cardboard or other suitable material. The material(s) forming the extender 100, 200 may be disposable. However, in some embodiments, the extender 100, 200 may be made of a material that can be reused without significant risk of damage if exposed to environmental elements. In further embodiments, the extender 100, 200 may be made out a metal, such as aluminum, or plastic and can be recycled with the other contents within the receptacle 50, such as known recyclable items that are commonly discarded.

Figure 5:
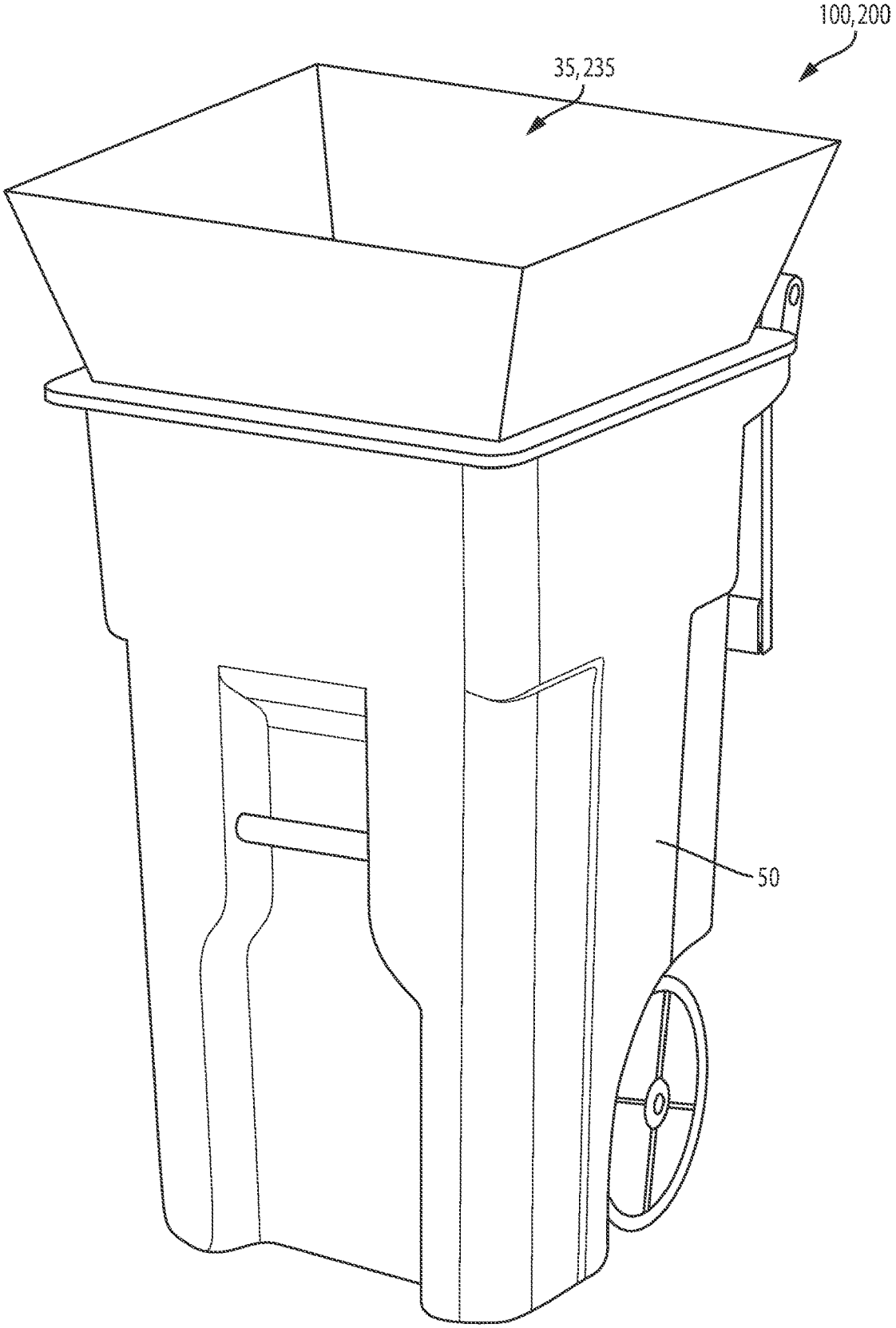
FIG. 5 depicts a perspective view of an embodiment of an extender operably configured with an embodiment of a receptacle.
Figure 6:
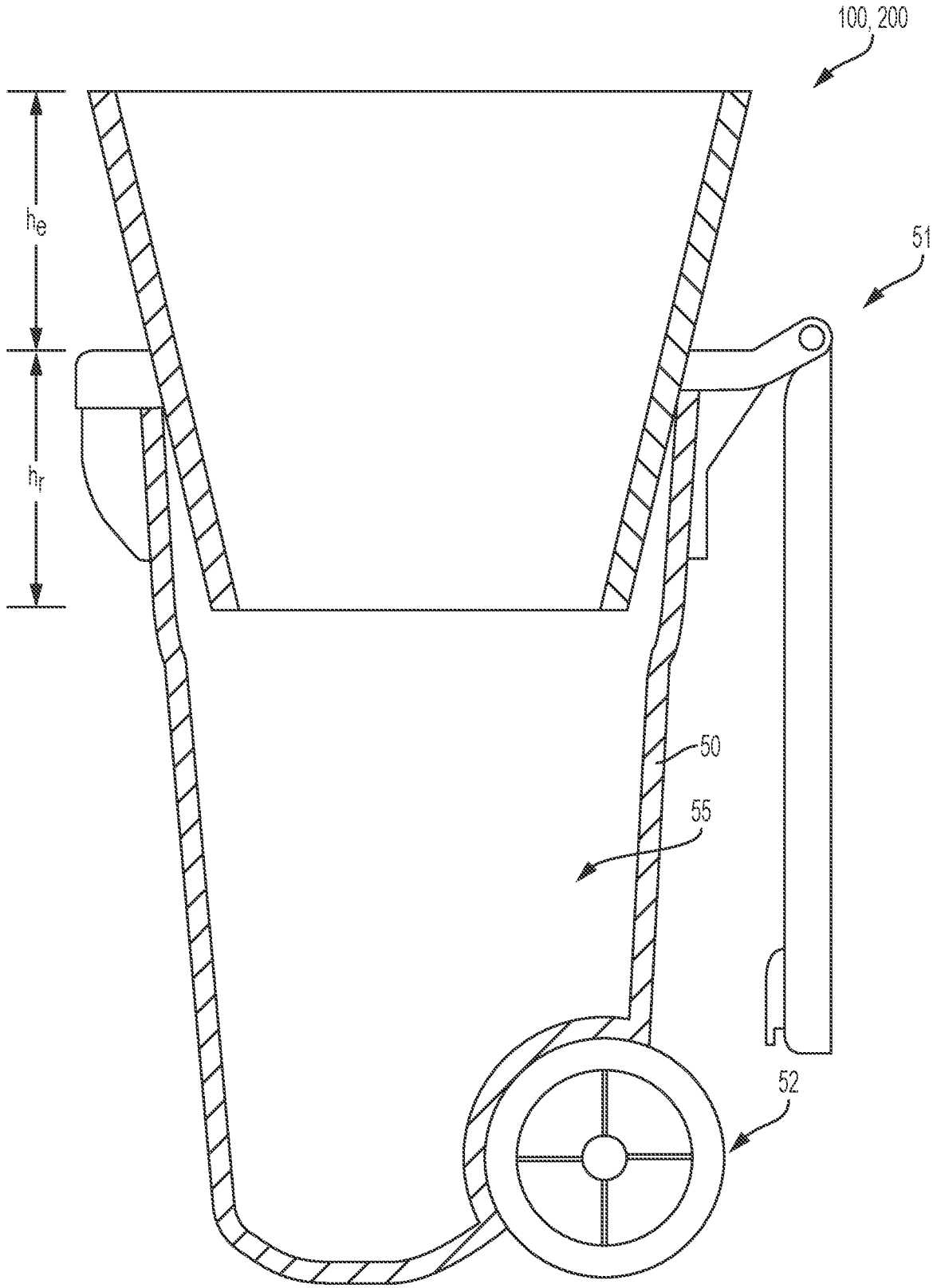
FIG. 6 depicts a sectional view of an embodiment of an extender operably configured with an embodiment of a receptacle.

Referring now to FIGS. 5 and 6, embodiments of extender 100, 200 are shown in an operable configuration and engaged with receptacle 50. The extender 100, 200 may be provided to an end user as a flat and/or folded unit, as described above, or may be provided to an end user partly folded or otherwise intact. If the extender 100, 200 comes in a folded or flat unit, a user may manipulate the plurality of walls 40*a*, 40*b*, 41*a*, 41*b* to form a box-like structure, as shown in FIGS. 5 and 6. Once assembled or otherwise formed into a box-like structure, the extender 100, 200 may be inserted within an interior 55 of the receptacle 50. Embodiments of the extender 100, 200 may be placed within the receptacle 50 from a top end 51 and driven further into the interior 55 of the receptacle 50. Because embodiments of the extender 100, 200 may be tapered, further displacement into the interior 55 of the receptacle 50 eventually results in mechanical interference between the walls 40*a*, 40*b*, 41*a*, 41*b*, or one or more deflection flaps 36, 236, and an inner surface 54 of the receptacle 50. The extender 100, 200 may be driven/pushed, forced, placed, etc. into the interior 55 of the receptacle 50 a distance, $h_r$, so as to provide a friction fit between the two components to prevent, hinder, or impede dislocation of the extender 100, 200 while the receptacle 50 is an upright, storage/collection position, as shown in FIGS. 5 and 6. In some embodiments, the extender 100, 200 may include a lip, edge, protrusion, or other surface feature that extends perpendicularly or substantially perpendicularly from an inner surface 34, 234 proximate, at, or otherwise near the second end 32, 232. The lip or engagement surface may extend perpendicularly into a center of the interior space 35, 235 so that waste materials 15 added into the extender 100, 200 may engage the lip to further hinder dislocation of the extender 100, 200 from the receptacle 50. The lip may be bent inwards by a user or may come perforated or creased for easy folding. The distance, represented by $h_r$, the extender 100, 200 enters the interior 55 of the receptacle 50 may vary and may depend on a size of the receptacle 50. In this position, the extender 100, 200 may be physically pulled out from and removed from the receptacle 50 by a user, but may be able to withstand other external forces such as wind, rain, addition of waste materials 55 to the receptacle, and the like. Furthermore, in this position, the extender 100, 200 may protrude, extend, or otherwise rise from a top end 51 of the receptacle 50 a distance, $h_e$, which may represent an increased storage capacity for waste materials 15. For instance, when waste materials 15 fill or substantially fill the interior 55 of the receptacle 50, the extender 100, 200 may be utilized to add an additional storage volume to the receptacle 50. The volume added depends on the distance, $h_e$, or height, the walls 40*a*, 40*b*, 41*a*, 41*b* extend from a top end 51 of the receptacle 50, as well as the width of each of the walls 40*a*, 40*b*, 41*a*, 41*b*. Thus, additional waste materials 15 (i.e. in addition to waste materials 15 already stored or located within the interior 15 of the receptacle 50) may be collected, stored, accommodated, received, etc. between the walls 40*a*, 40*b*, 41, 41*b* of the extender 100, 200, when the extender 100, 200 is engaged with the receptacle 50.

Figure 7:
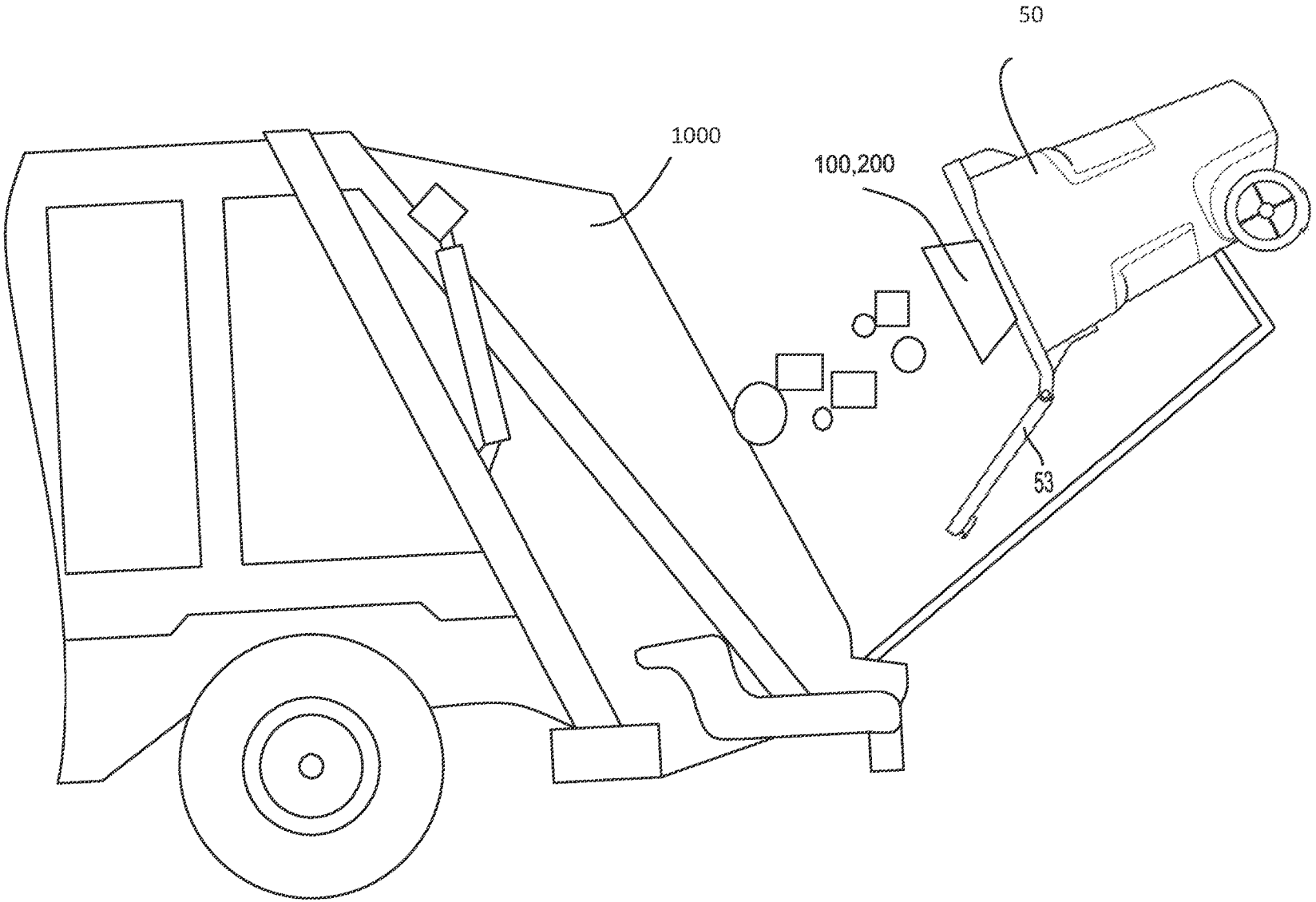
FIG. 7 depicts a schematic view of a first position of a receptacle being lifted and inverted for removal of waste contents.
Figure 8:
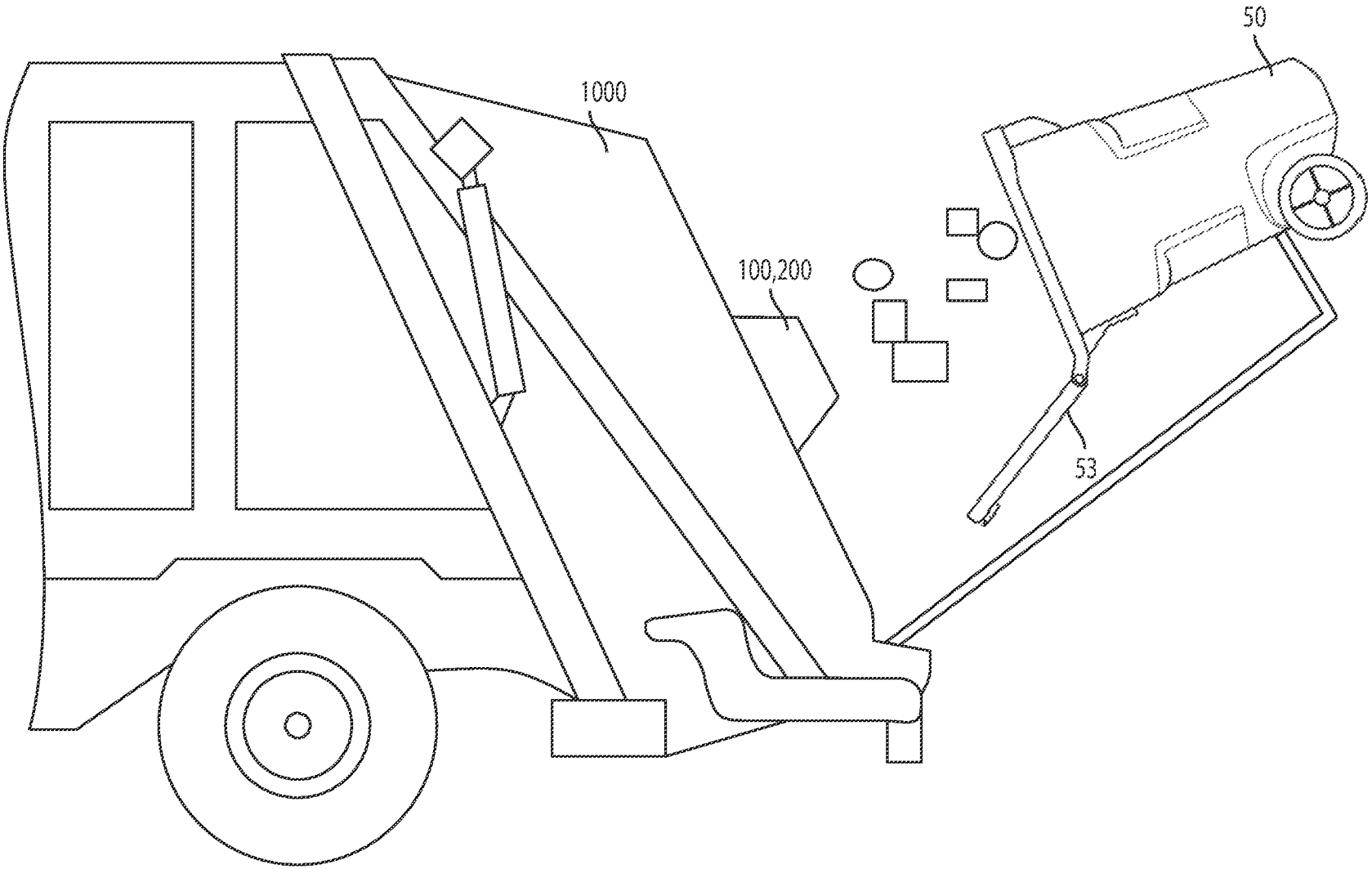
FIG. 8 depicts a schematic view of a second position of a receptacle being lifted and inverted for removal of waste contents.

With reference now to FIGS. 7 and 8, a manner in which the waste materials 15 and the extender 100, 200 may be disposed is now described. While the receptacle 50 is in an upright, collection position, with the extender 100, 200 operably engaged with the receptacle 50, waste materials 15 may be collected and stored for eventual pickup and removal by a garbage removal company or municipality service. When it comes time for the waste materials 15 to be picked up and removed, the garbage collectors may utilize a collection vehicle 1000, such as a garbage truck, to secure, grab, or otherwise manipulate the receptacle 50 to invert, at least to some degree, the receptacle 50 to allow the waste materials 15 to exit the interior 55 of the receptacle 50 and into a collection area of the collection vehicle 1000. As shown in FIG. 7, an initial amount or portion of the waste materials 15 may exit the extender 100, 200 and/or the receptacle 50 and into the collection area of the collection vehicle 1000. As the waste materials 15 continue to exit the receptacle 50, a weight of the remaining waste materials 15 passing by the extender 100, 200 may engage the extender 100, 200, for example, may engage an internal lip of the extender 100, 200 proximate the second end 32, 232, and may help drive or otherwise urge the extender 100, 200 out of physical engagement with the inner surface 55 of the receptacle 50, and into the collection area of the collection vehicle 100 along with other waste materials 15, as shown in FIG. 8. Therefore, the waste materials 15 and the extender 100, 200 are efficiently disposed of and collected in a single motion—or a single lift and invert of the receptacle 50. This may save time for the garbage collectors because they do not need to stop, bend over, and hand collect waste material stacked next to the receptacle 50 because the receptacle 50 lacked the capacity to store all of the waste. Further, no additional time may be wasted to collect the additional waste materials 15 collected/stored by the presence/use of the extender 100, 200 because the extender 100, 200 may be disposed of and collected by the garbage collection vehicle 1000 in the same motion as if just collecting the waste stored in the receptacle 50.

In alternative embodiments, a garbage collector(s) may physically lift and invert the receptacle 50 with the extender 100, 200 attached thereto and empty into a garbage collection vehicle 1000, or suitable collection means. The extender 100, 200 may likewise disengage from the receptacle 50 for disposal along with the waste materials 15.

Figure 9:
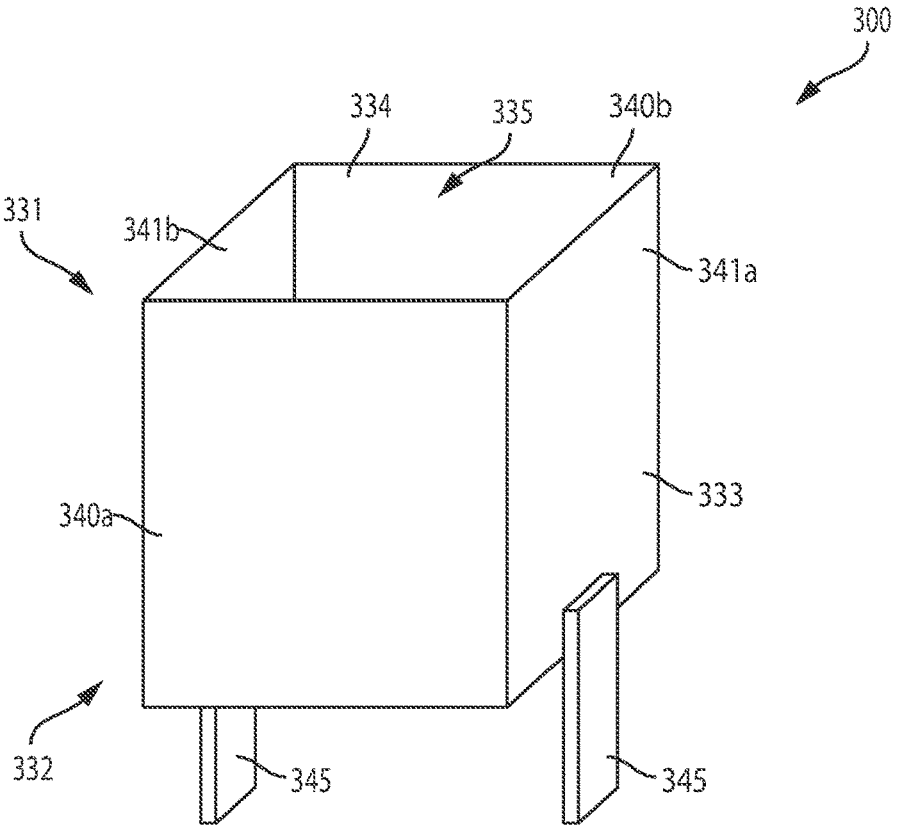
FIG. 9 depicts a perspective view of a third embodiment of an extender.
Figure 10:
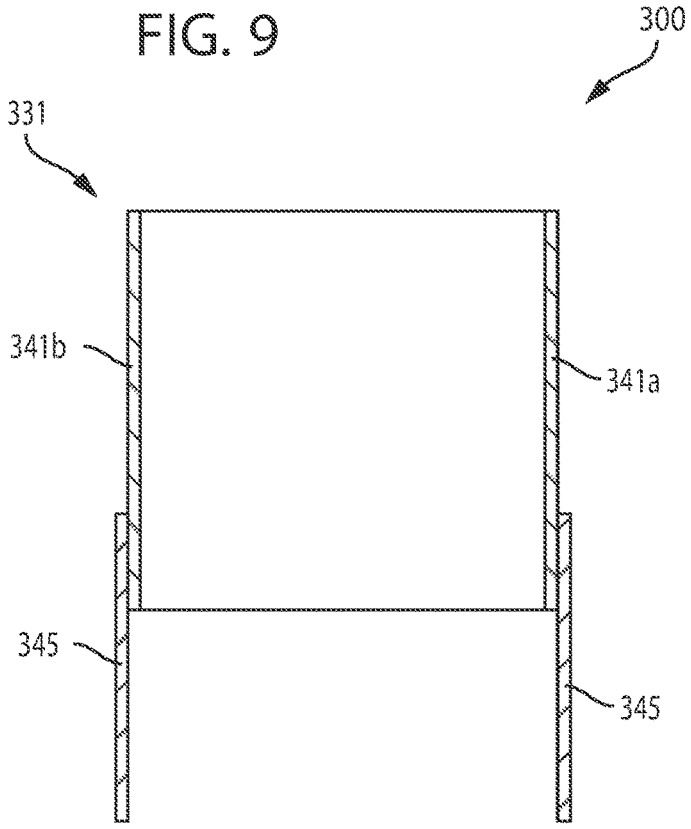
FIG. 10 depicts a sectional view of the third embodiment of an extender.

With continued reference to the drawings, FIGS. 9 and 10 depict an embodiment of extender 300. Embodiments of extender 300 may be a box, an add-on, a cardboard structure, a garbage containment unit, a cardboard accessory, or the like, sized and dimensioned to be placed on top of a cover 53 of a receptacle 50 of various sizes. The extender 300 may be a device that may be configured to be placed upon a cover 53 of a receptacle 50, such as industry standard sized garbage can, to extend or otherwise increase a capacity of the receptacle 50. The increased capacity may be an amount of volume for storing garbage, waste, yard waste, leaves, etc., or any contents suitable for placement in a receptacle that is in addition to a maximum volume afforded by the receptacle 50. For example, if the receptacle 50 becomes full of waste materials 15, such as garbage, waste, recyclables, yard waste, and the like, any additional waste materials will not fit properly within the receptacle 50, and likely fall to the side of the receptacle 50, or can blow away due to the wind or other environmental elements. To increase a volume or storage capacity of the receptacle 50, embodiments of an extender 300 may be placed on a top of a receptacle 50 so that additional waste materials 15 may be stored in addition to the waste material already stored within the receptacle 50. While the extender 300 is operatively attached to the receptacle 50, a storage capacity of the receptacle 50 is effectively increased because of the additional capacity or volume afforded by the extender 300. Embodiments of the receptacle 50 may be a garbage can, a pail, a garbage pail, a transportable waste container, a waste collection device, a barrel, a bucket, and the like. In some embodiments, the receptacle 50 may include a cover 53 that can be hingedly or otherwise pivotally attached to the receptacle 50. Further, embodiments of receptacle 50 may be various sizes, as might be offered/provided by a waste collection company or a municipality, or otherwise available for purchase at a home improvement store.

Embodiments of extender 300 may include a first end 331, a second end 332, an outer surface 333, an inner surface 334, and a general opening extending therethrough. Moreover, embodiments of the extender 300 may include a plurality of walls 340*a*, 340*b*, 341*a*, 341*b*. Each of the plurality of walls 340*a*, 340*b*, 341*a*, 341*b* may be shaped like a square or rectangle to form a box-like configuration having an interior space 335. A number and an arrangement of the plurality of walls, when operably configured, may correspond to a geometric shape of a cover 53 of the receptacle 50 so that it may efficiently rest upon a cover 53 of the receptacle 50. In one embodiment, the extender 300 may include four walls, with a front wall 340*a*, a back wall 340*b*, a first side wall 341*a*, and a second side wall 341*b*; embodiments of the extender 300 may include an optional bottom wall and/or a top wall, wherein the top wall may be opened when needed to place contents therein and closed to hinder access, provide protection against rain or other environmental elements, and/or minimize odor. For instance, a top wall may be movably or pivotally attached to the at least on the walls 340*a*, 34*b*, 341*a*, 34 lb. The walls 340*a*, 340*b*, 341*a*, 341*b* may be equal in size, or may vary in size with respect to each other. Furthermore, the walls 340*a*, 340*b*, 341*a*, 341*b* may be structurally integral with each other and joined along each edge to the next wall, as shown in FIG. 9. The edges may be creased or pre-creased to facilitate or promote flexibility of the extender 300. The flexibility of the extender 100 may vary, but in some cases, the extender 300 may be able to be folded into a flat unit, while all of the edges of the walls 340*a*, 340*b*, 341, 341*b* remain connected, structurally integral or otherwise.

Furthermore, embodiments of extender 300 may include at least one edge of one of the plurality of walls 340*a*, 340*b*, 341*a*, 341*b* may be a free edge, which may also allow the extender 300 to be packaged and sold as a flat, or relatively flat, or a folded flat unit. For example, a left edge of front wall 340*a* may be a free edge, while the other, right, edge of the front wall 340*a* is connected to the left edge of first side wall 341*a*. In this example, an edge of the second side wall 341*b* may also be a free edge. Any configuration or combination of free edges may be implemented to form extender 300. In some operable configurations, the free edges may be connected to each other for added stability once ready for use. For instance, the free edges may be connected to each other using a connection element, such as a component similar to connection element 245 described supra. In other operable configurations, the free edges may remain unconnected when placed within the receptacle 50, wherein the free edges are proximate or otherwise near each other when in this operable configuration.

Figure 11:
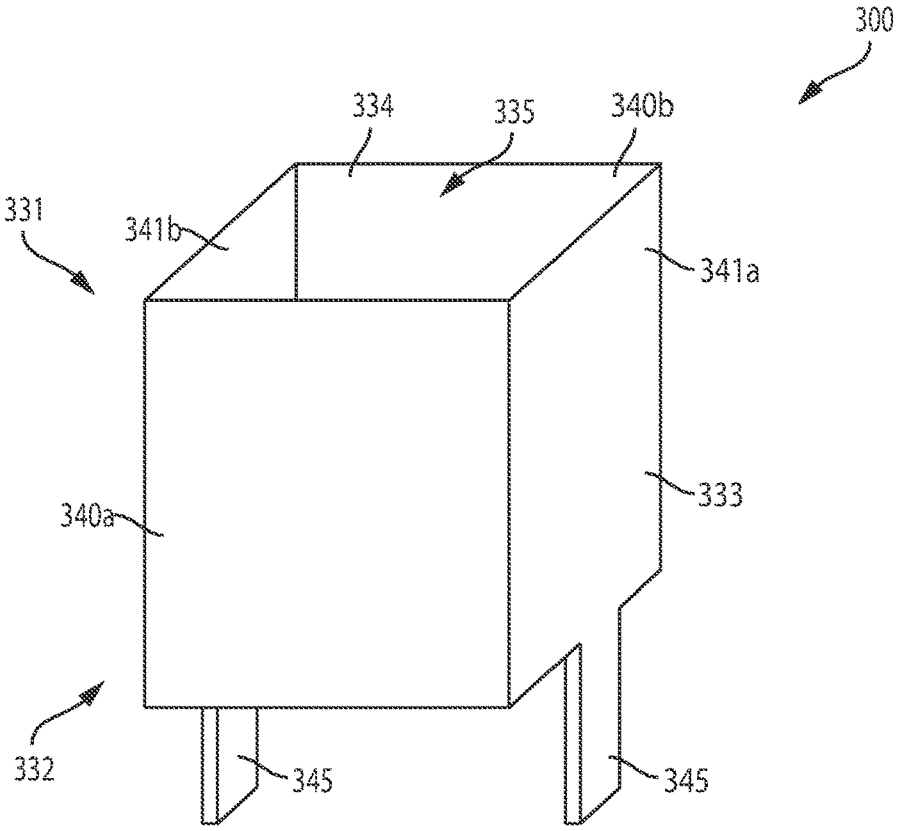
FIG. 11 depicts a perspective view of the third embodiment of an extender having at least one structurally integral wing.
Figure 12:
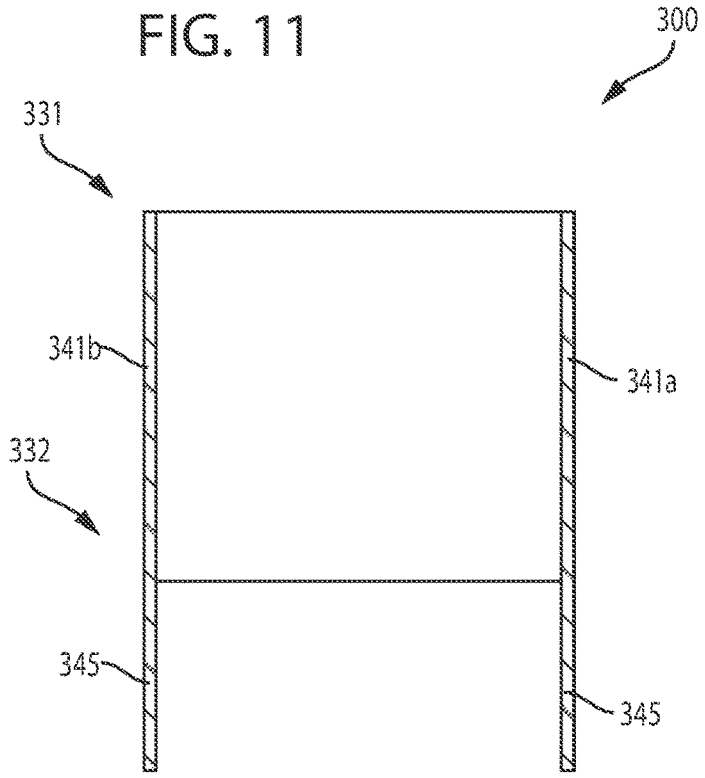
FIG. 12 depicts a sectional view of the third embodiment of an extender having one or more structurally integral wing.

Referring still to FIGS. 9 and 10, embodiments of extender 300 may include one or more wings 345. Embodiments of the one or more wings 345 may be a wing, a strap, a flap, a connector, a securing strap, a securing element, and the like. Embodiments of the one or more wings 345 may be a separate section of material that is operably attached to one or more walls, such a first side wall 341*a* and a second side wall 341*b*. For example, wings 345 may be affixed, adhered, stapled, or otherwise secured to one or more side walls of the extender 300. Alternatively, embodiments of wings 345 may be structurally integral with one or walls 340*a*, 340*b*, 341*a*, 341*b* of the extender 300, as shown in FIGS. 11 and 12. Embodiments of the one or more wings 345 may protrude, extend, or hang down beyond a second end 332 of the extender 300 a distance to allow the wings 345 to be manipulated for operable engagement with the receptacle 50. Furthermore, embodiments of the extender 300 may be made out of cardboard or other suitable material. The material(s) forming the extender 300 may be disposable. However, in some embodiments, the extender 300 may be made of a material that can be reused without significant risk of damage if exposed to environmental elements. In further embodiments, the extender 300 may be made out a metal, such as aluminum, or plastic and can be recycled with the other contents within the receptacle 50, such as known recyclable items that are commonly discarded. In even further embodiments, waste materials 15 may be segregated by type/contents by locating certain materials in the extender 300, and the more conventional or non-hazardous contents in the interior 55 of the receptacle 50. For example, normal waste materials 15 may be kept in the receptacle 50, while batteries may be placed within the interior space 335 of the extender 300 to separate the contents, making it easier for collection companies to sort contents. Sorting contents may be made easier because the contents of extender 300 may be dumped into a separate compartment of the collection vehicle 1000 (e.g. recyclables, hazardous, etc.)

Figure 13:
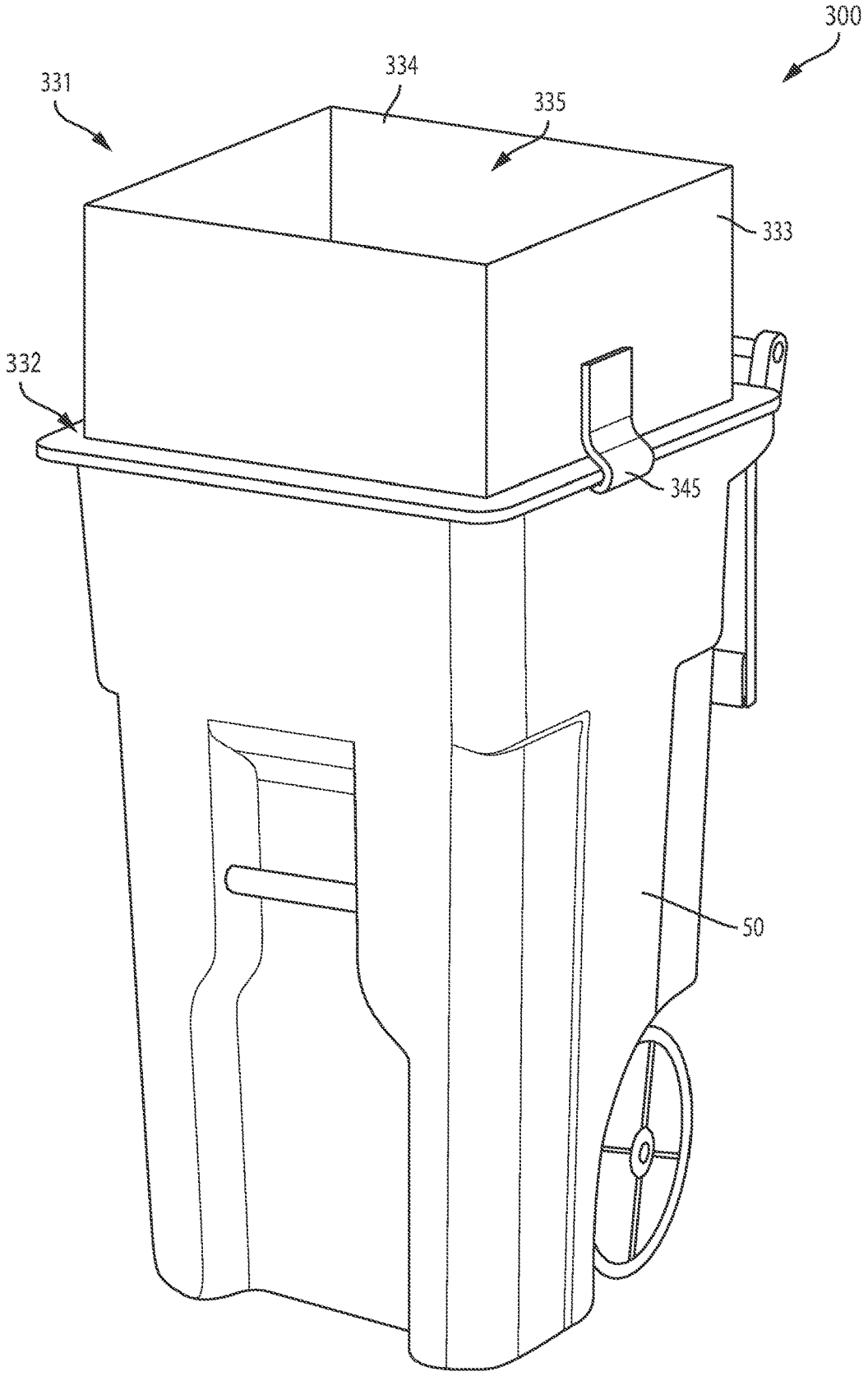
FIG. 13 depicts a perspective view of the third embodiment of the extender operably configured with an embodiment of a receptacle.
Figure 14:
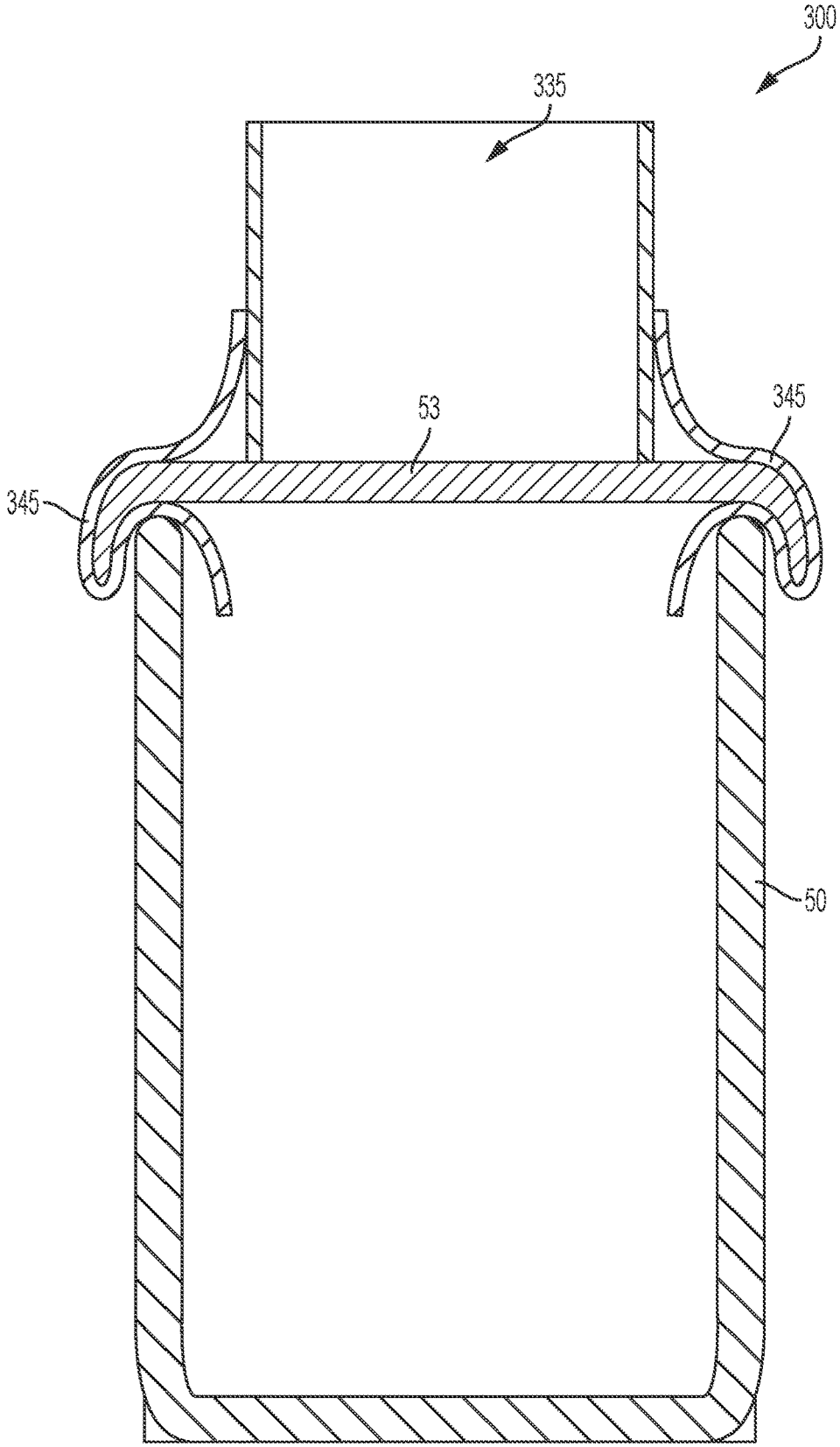
FIG. 14 depicts a sectional view of the third embodiment of the extender operably configured with an embodiment of a receptacle.

Referring now to FIGS. 13 and 14, an embodiment of extender 300 is shown in an operable configuration and engaged with receptacle 50. The extender 300 may be provided to an end user as a flat and/or folded unit, as described above, or may be provided to an end user partly folded or otherwise intact. If the extender 300 comes in a folded or flat unit, a user may manipulate the plurality of walls 340*a*, 340*b*, 341*a*, 341*b* to form a box-like structure, as shown in FIGS. 8-11. Once assembled or otherwise formed into a box-like structure, the extender 300 may be placed on a cover 53 of a receptacle 50 (e.g. when the cover 53 is closed over a top end 51 of the receptacle 50). Because the one or more wings 345 may protrude, extend, or hang down beyond a second end 332 of the extender 300 a distance, the wings 345 may be manipulated so as to be placed underneath a cover 53 of the receptacle 50 and into an interior 55 of the receptacle 50. For instance, a user may place the extender 300 on top of the receptacle 50, and at least slightly open the cover 53, and when the cover 52 is at least slightly open, the user may insert the one or more wings 345 into the interior 55 of the receptacle 50, and then return the cover 53 to a closed positon. A weight of the cover 53 may secure the extender 300 in a collection position atop the receptacle 50, thus affording the receptacle 50 an increased storage capacity for waste materials 15. As more waste materials 15 are placed within the interior space 335 of the extender 300, an additional weight/force can be applied to the cover 53, thus increasing the force exerted against the one or more wings 345.

Accordingly, in this position, the extender 300 may protrude, extend, or otherwise rise from a top cover 53 of the receptacle 50 a distance, which may represent an increased storage capacity for waste materials 15. For instance, when waste materials 15 fill or substantially fill the interior 55 of the receptacle 50, the extender 300 may be utilized to add an additional storage volume to the receptacle 50. The volume added depends on the distance, or height, the walls 340*a*, 340*b*, 341*a*, 341*b* extend from a top end 51 of the receptacle 50, as well as the width of each of the walls 340*a*, 340*b*, 341*a*, 341*b*. Thus, additional waste materials 15 (i.e. in addition to waste materials 15 already stored or located within the interior 15 of the receptacle 50) may be collected, stored, accommodated, received, etc. between the walls 340*a*, 340*b*, 341, 341*b* of the extender 300, when the extender 300 is engaged with the receptacle 50.

Figure 15:
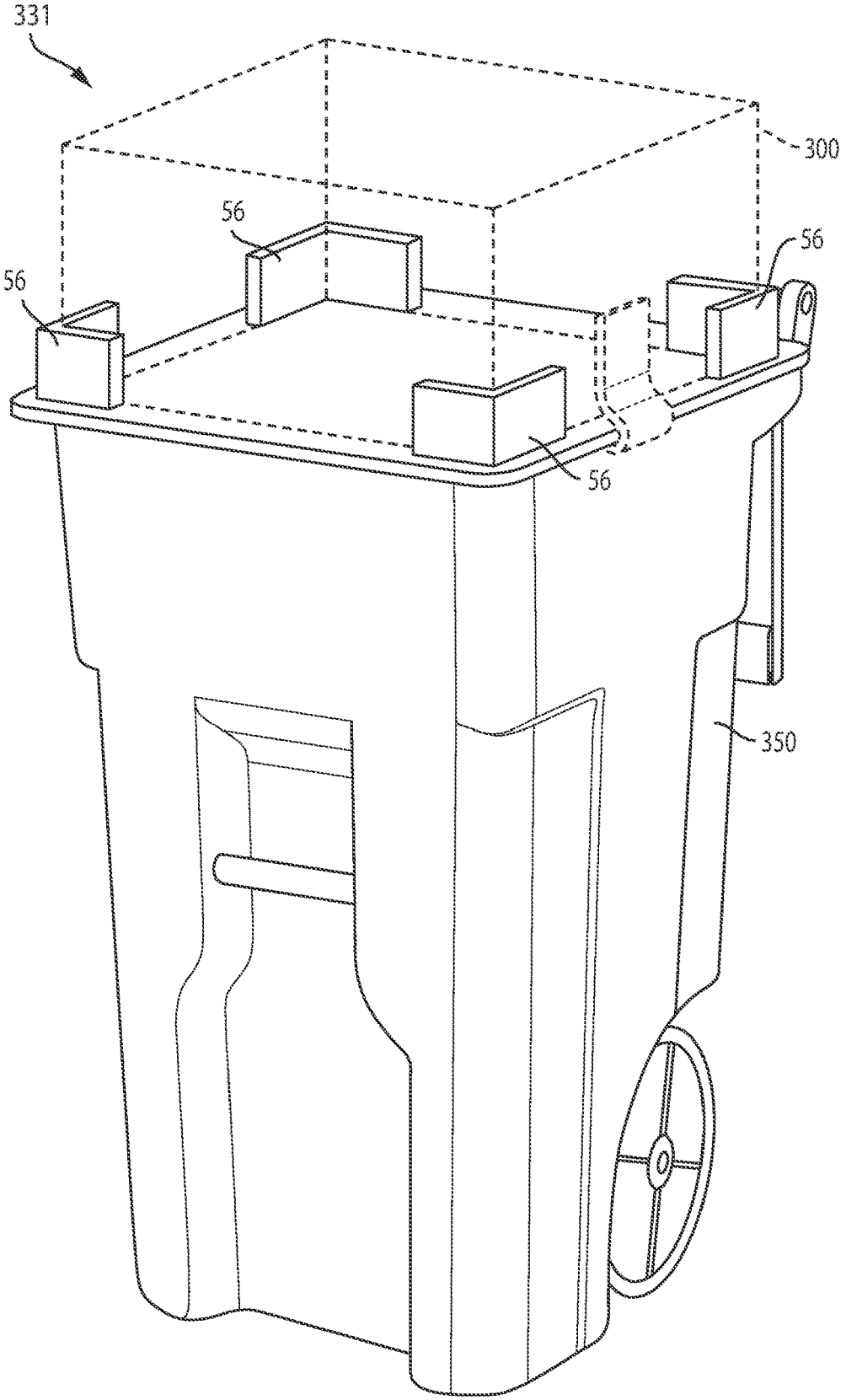
FIG. 15 depicts a perspective view of an embodiment of a receptacle having a plurality of support elements.

FIG. 15 depicts an embodiment of a receptacle 50 that may include a plurality of support elements 56. Embodiments of support elements 56 may be supports, box supports, extender supporters, framing elements, guide elements, corner elements, or any suitable component for preventing or hindering slidable movement of the extender 300 across the cover 53 of the receptacle 50 when placed atop the receptacle 50. Embodiments of the support elements 56 may be positioned in or more corner locations of the cover 53 of the receptacle 50. Additionally, support elements 56 may be positioned on the cover 53 at a location that may correspond to where a wall 340*a*, 340*b*, 341*a*, 341*b* engage the cover 53 of the receptacle 50. Embodiments of the support elements 56 may include a right angle or a substantially right angle to accommodate or correspond with a corner of the extender 300. Embodiments of the support elements 56 may include a first wall and a second wall, or a single wall, that may protrude or extend upwards from the cover 53 of the receptacle. Thus, an extender 300 may be placed between the support elements 56, wherein the support elements 56 may prevent or hinder slidable movement of the extender 300 to help retain the extender 300 in position. Further, embodiments of the support elements 56 may be structurally integral with the cover 53, or may be separately attached to the cover 53, and may be made of the same or different material of the cover 53. In most embodiments, the support elements 56 may be comprised of a rigid material.

Figure 16:
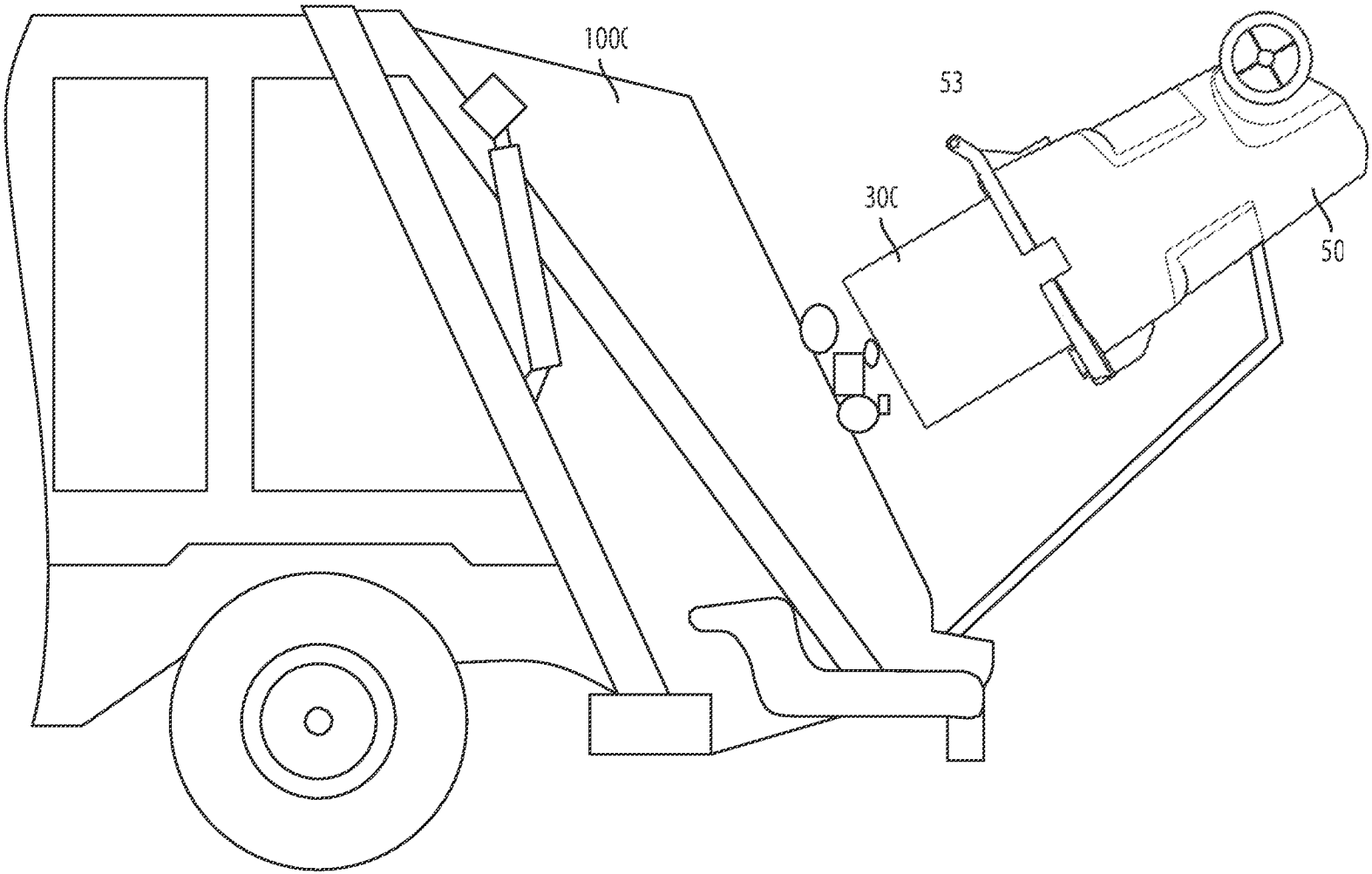
FIG. 16 depicts a schematic view of a first position of a receptacle being lifted and inverted for removal of waste contents.
Figure 17:
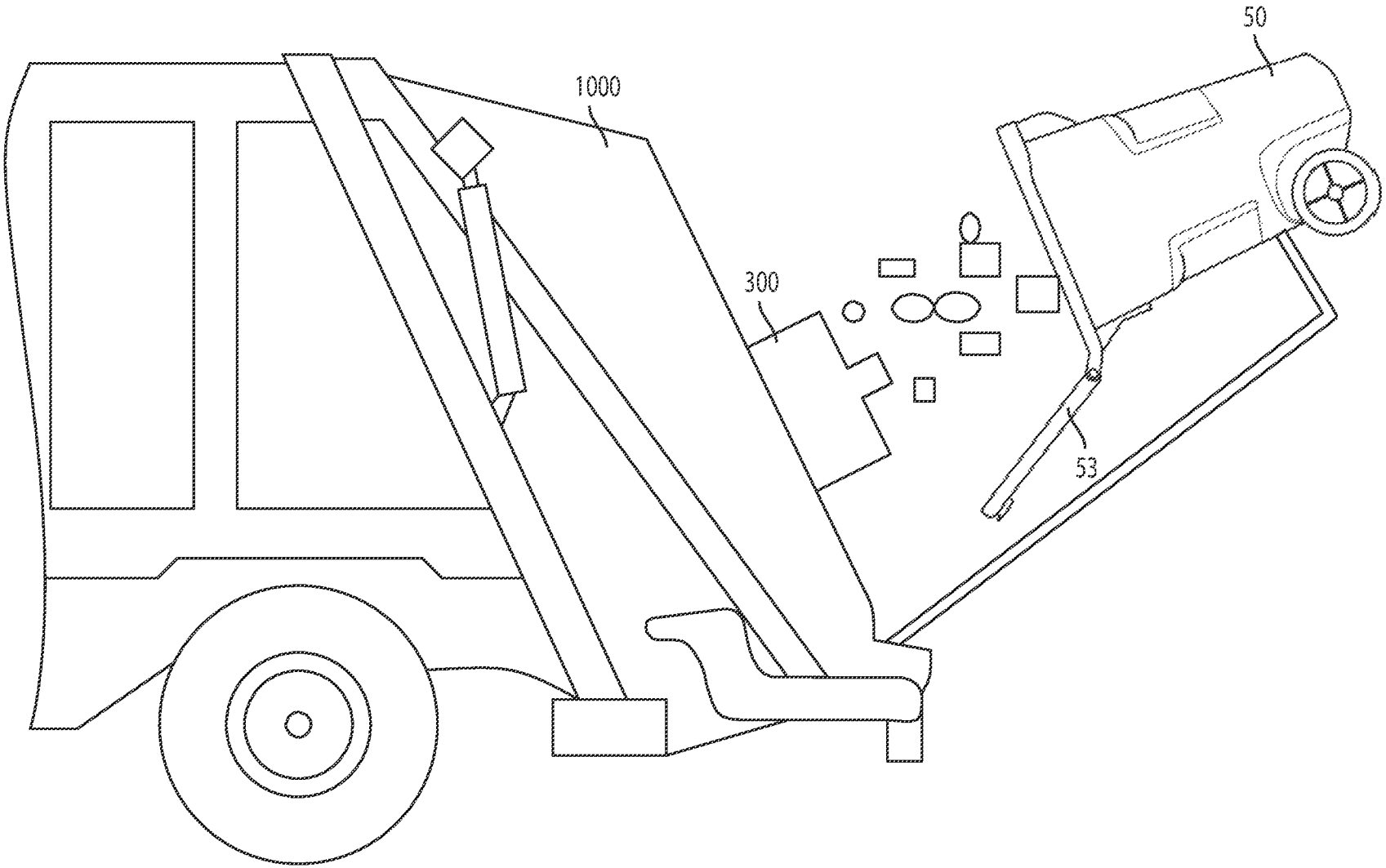
FIG. 17 depicts a schematic view of a second position of a receptacle being lifted and inverted for removal of waste contents.

With reference now to FIGS. 16 and 17, a manner in which the waste materials 15 and the extender 300 may be disposed is now described. While the receptacle 50 is in an upright, collection position, with the extender 300 operably engaged with the receptacle 50, waste materials 15 may be collected and stored for eventual pickup and removal by a garbage removal company or municipality service. When it comes time for the waste materials 15 to be picked up and removed, the garbage collectors may utilize a collection vehicle 1000, such as a garbage truck, to secure, grab, or otherwise manipulate the receptacle 50 to invert, at least to some degree, the receptacle 50 to allow the waste materials 15 to exit the interior 55 of the receptacle 50 and into a collection area of the collection vehicle 1000. As shown in FIG. 15, an initial amount or portion of the waste materials 15 may exit the extender 300 into the collection area of the collection area. As the waste materials 15 exit the extender 300 and the receptacle 50 is at least partially inverted, the cover 53 also begins to open, releasing the one or more wings 345 of extender 300. When the one or more wings 345 are released (i.e. the cover 53 no longer pinches the wings 345 against a top lip of the receptacle 50), the extender 300 is physically disengaged with the receptacle 50, and drops into the collection area of the collection vehicle 100 along with other waste materials 15, as shown in FIG. 16. Therefore, the waste materials 15 and the extender 300 are efficiently disposed of and collected in a single motion—or a single lift and invert of the receptacle 50. This may save time for the garbage collectors because they do not need to stop, bend over, and hand collect waste material stacked next to the receptacle 50 because the receptacle 50 lacked the capacity to store all of the waste. Further, no additional time may be wasted to collect the additional waste materials 15 collected/stored by the presence/use of the extender 300 because the extender 300 may be disposed of and collected by the garbage collection vehicle 1000 in the same motion as if just collecting the waste stored in the receptacle 50.

In alternative embodiments, a garbage collector(s) may physically lift and invert the receptacle 50 with the extender 300 attached thereto and empty into a garbage collection vehicle 1000, or suitable collection means. The extender 300 may likewise disengage from the receptacle 50 for disposal along with the waste materials 15.

Figure 18:
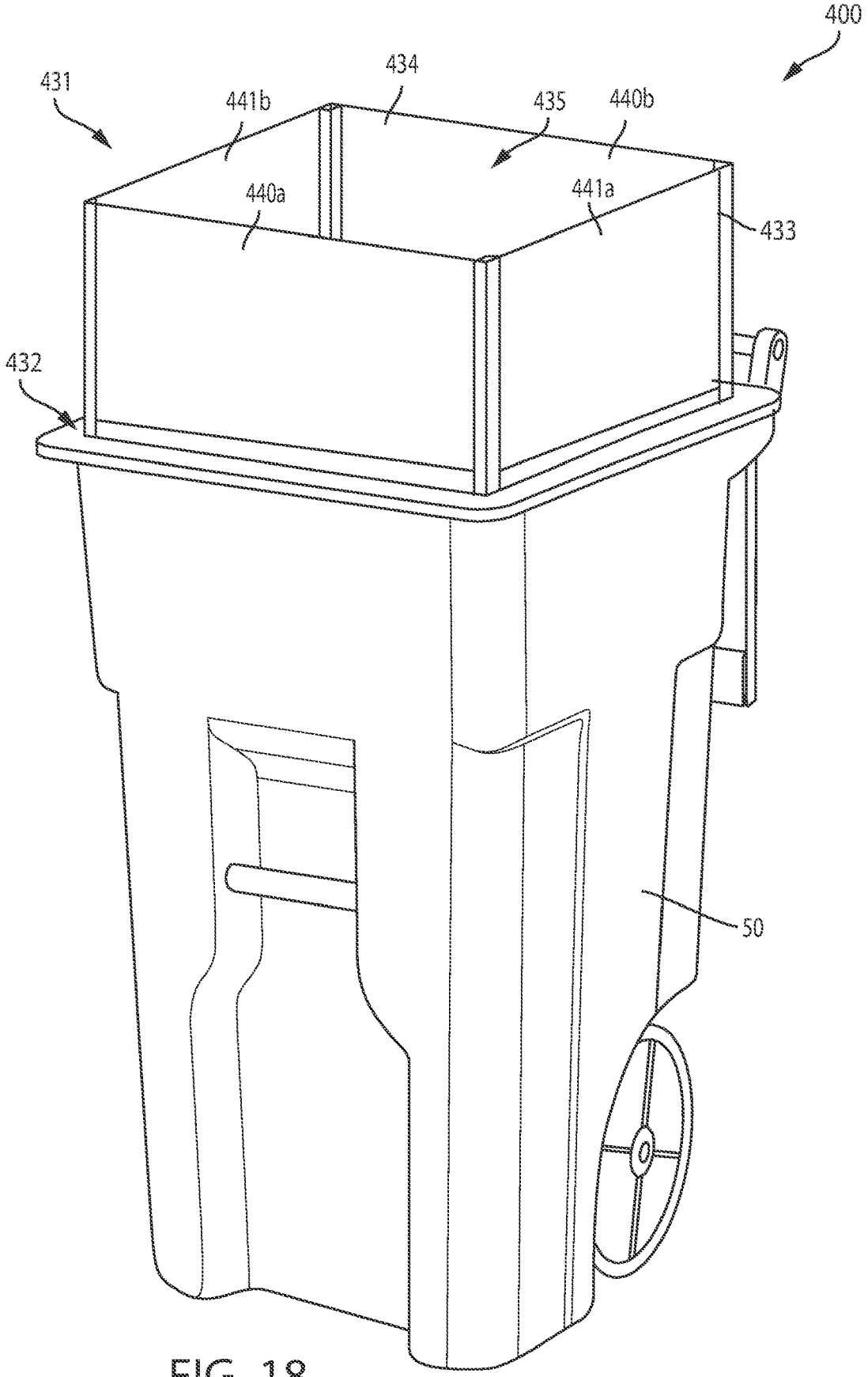
FIG. 18 depicts a perspective view of a fourth embodiment of an extender operably configured with a receptacle.
Figure 19:
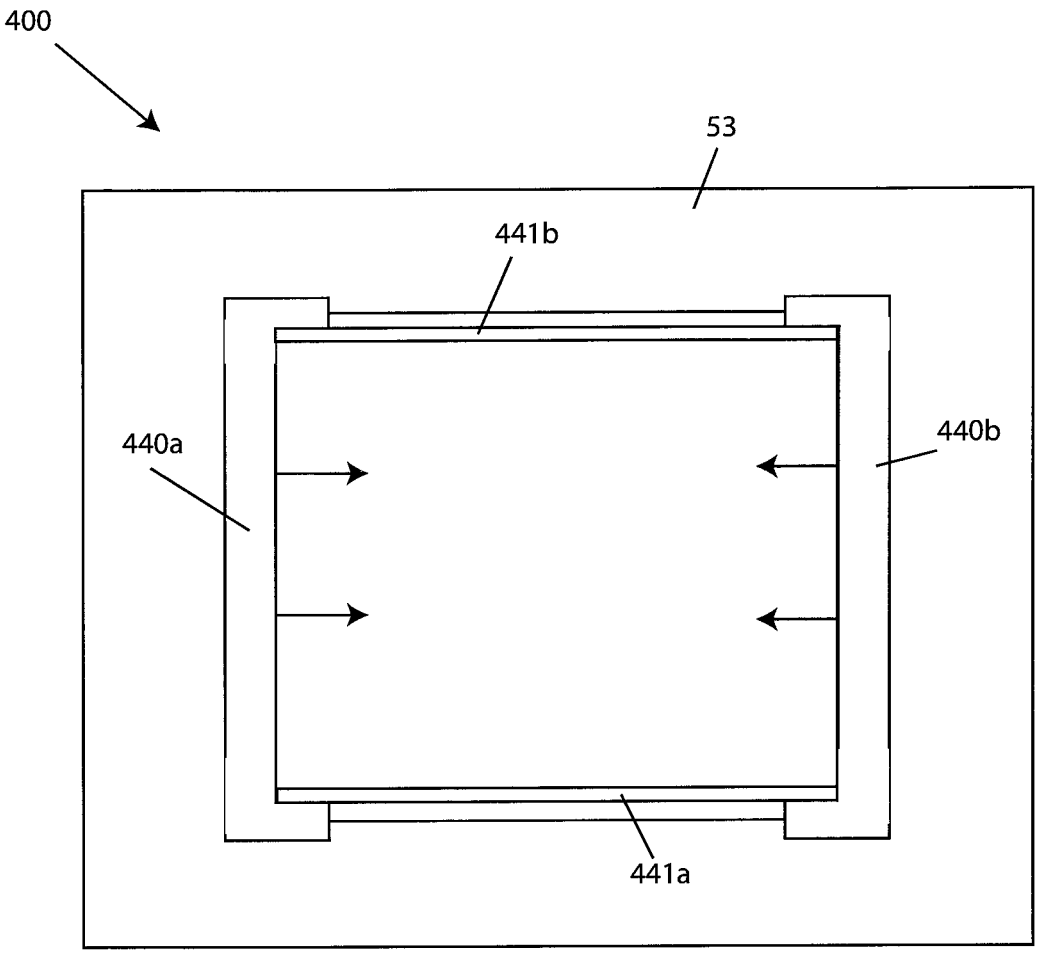
FIG. 19 depicts a top view of the fourth embodiments of an extender operably configured with a receptacle.

FIGS. 18 and 19 depict yet another embodiment of an extender 400. Embodiments of extender 400 may be permanently attached to a receptacle 50. For instance, embodiments of extender 400 may be permanently attached to a cover 53 of the receptacle 50. Embodiments of extender 400 may be collapsible, such that when additional storage capacity is not needed, the extender 400 may be collapsed into a first, flat position, and when needed to increase a storage capacity of the receptacle 50, the extender 50 may be unfolded or moved to a second, erect position. Moreover, embodiments of the extender 400 may include a plurality of walls 440*a*, 440*b*, 441*a*, 441*b*, an outer surface 433, and inner surface 434, and an interior space 435 to accommodate waste materials 15. At least two of the walls 440*a*, 440*b*, 441*a*, 441*b* may be spring loaded and hingedly movable from a flat position to an upright, erect position. While the spring loaded walls are held erect or partially erect, another wall, which may not be spring loaded, can be raised to fit between the spring loaded wall. The force of the spring loaded wall acting on either side of the free standing wall will keep the walls erect, and in the second, upright position configured to received and store waste materials 15 beyond or in addition to the waste materials 15 stored within the receptacle 50. A remaining wall, which may not be spring loaded, may also be lifted upright so as to fit between the spring loaded walls to complete the extender 400. While embodiments of extender 400 may not be disposable, the method and manner in which the contents of both the extender 400 and receptacle 50 are emptied may be similar to the methods described with respect to extender 100, 200, 300.

Figure 20:
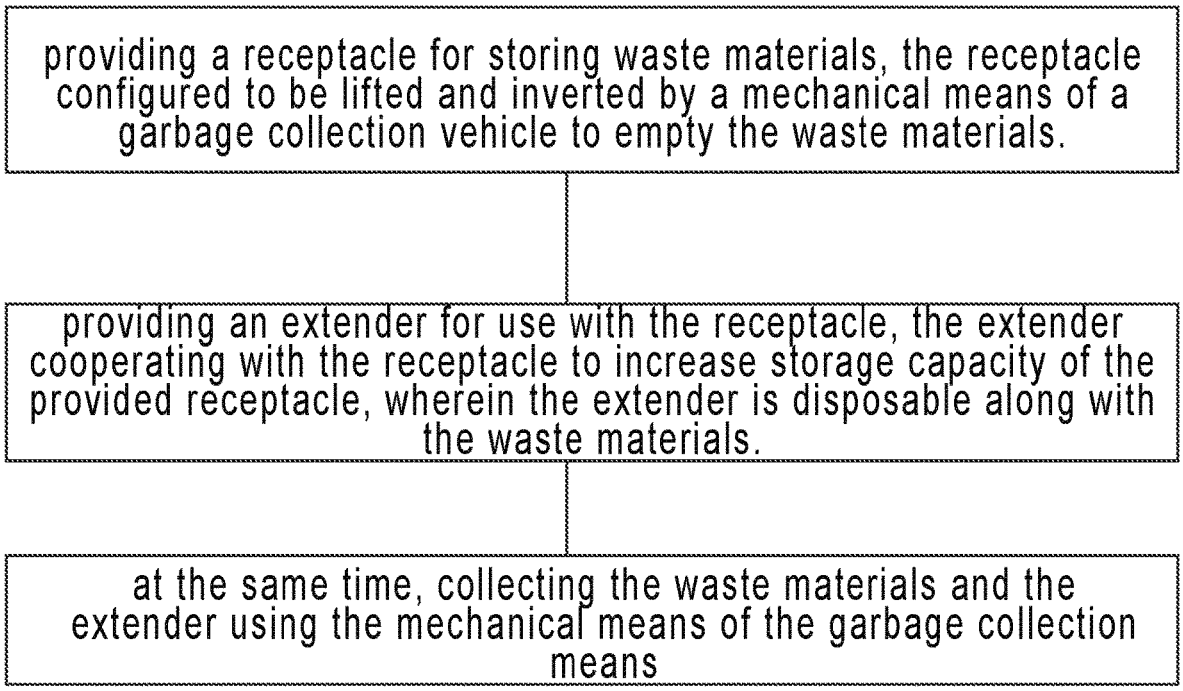
FIG. 20 depicts a flowchart of an embodiment of a method.

Referring now to FIGS. 1-19, and additional reference to FIG. 20, embodiments of a method for collecting garbage may include a step of providing a receptacle, such as receptacle 50, for storing waste materials. For example, a garbage collecting service may provide homeowners, users, renters, etc. with a receptacle 50 of a certain size, wherein the receptacle 50 may be configured to be lifted and inverted by a mechanical means of a garbage collection vehicle 1000 to empty the waste materials 15 within the receptacle 50. Another step may be to provide an extender 100, 200, 300 for use with the receptacle 50, the extender cooperating with the receptacle 50 to increase a storage capacity of the provided receptacle 50, wherein the extender 100, 200, 300 is disposable along with the waste materials 15. Another step may be collecting the waste materials 15 and the extender 100, 200, 300 at the same time, using the mechanical means of the garbage collection means 1000. For example, the extender 100, 200, 300 and the receptacle 50 may be emptied of waste materials in a same motion. This method may save labor time for the garbage collectors because a driver or operator(s) may stay in the truck and pick up the receptacle according to existing methods, yet dump the contents of the extender (and potentially the extender itself) in the same motion. Moreover, the method may allow customers to purchase a smaller trash service (e.g. smaller size container) with a temporary means in which to increase a capacity of the purchased receptacle. The disposability of the extender 100, 200, 300 may be a cost-effective alternative to buying a larger receptacle service, and may be a way for a garbage service collection company to secure more customers by including one or more extenders in a package.

Figure 21:
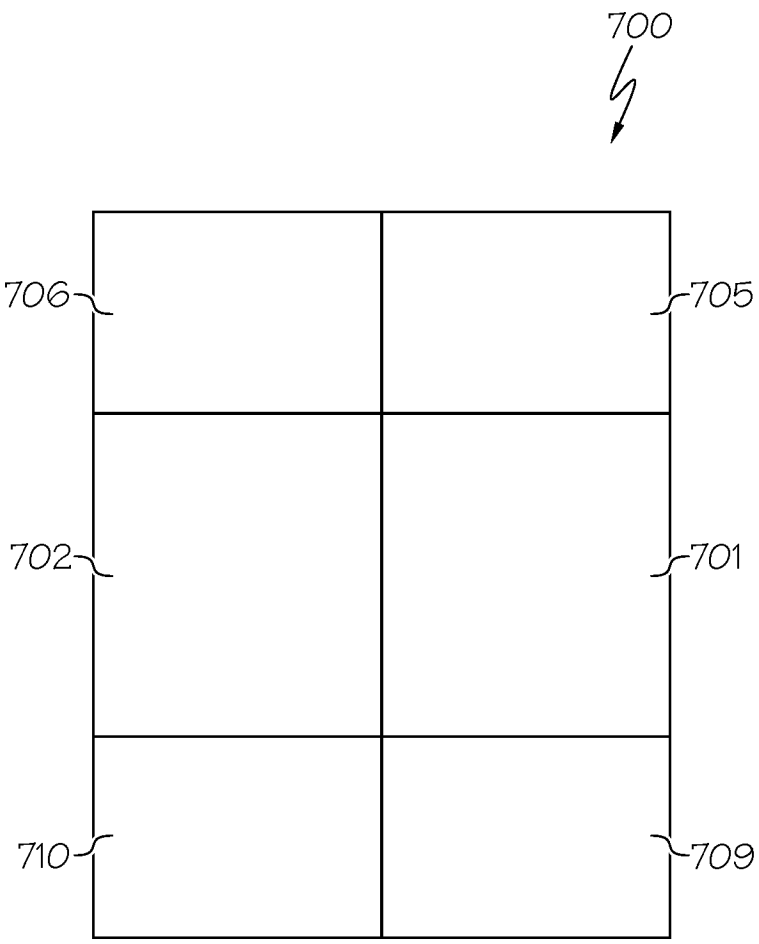
FIG. 21 depicts a front view of an embodiment of an extender in a first pre-assembled flat position.

Referring now to FIGS. 21-32, another embodiment of a transformative extender 700 is shown. Transformative extender 700 may be a receptacle support device. Transformative extender 700 may be a container that is foldable into an extender for a waste receptacle. In an exemplary embodiment, transformative extender 700 is configured to transform into an closable container. Transformative extender 700 may be made out of a flat piece of material. For instance, the transformative extender 700 may be made of a flat rectangular piece of material such as cardboard, plastic, corrugated plastic, etc. wherein the flat rectangular piece of material is configured to be folded into a closeable container. Referring to FIG. 21, an embodiment of the transformative extender 700 is shown in a first pre-assembled flat position. In an exemplary embodiment, transformative extender 700 has a first wall 701, a second wall 702, a third wall 703 (not shown), and a fourth wall 704 (not shown). In this exemplary embodiment, the transformative extender 700 further has a first top extension 705 extending from a top edge of the first wall 701, a second top extension 706 extending from a top edge of the second wall 702, a third top extension 707 (not shown) extending from a top edge of the third wall 703, and a fourth top extension 708 (not shown) extending from a top edge of the fourth wall 704. In this exemplary embodiment, the transformative extender 700 has a first bottom extension 709 extending from a bottom edge of the first wall 701, a second bottom extension 710 extending from a bottom edge of the second wall 702, a third bottom extension 711 (not shown) extending from a bottom edge of the third wall 703, and a fourth bottom extension 712 (not shown) extending from a bottom edge of the fourth wall 704. The top extensions 705, 706, 707, 708 and the bottom extensions 709, 710, 711, and 712 are shown as rectangular in shape, though it should be understood that the top extensions 705, 706, 707, 708 and the bottom extensions 709, 710, 711, and 712 may be triangular in shape, or any other shape. The top extensions 705, 706, 707, and 708 may be tapered. The top extensions 705, 706, 707, 708 and the bottom extensions 709, 710, 711, and 712 may be flaps, walls, tabs, wings, strips, lids, and the like. The top extensions 705, 706, 707, 708 may be positioned opposite of the bottom extensions 709, 710, 711, 712.

With continuing reference to an exemplary embodiment shown in FIG. 21, the walls 701-704 are configured to define an interior space 720 having a rectangular shape. The top extensions 705, 706, 707, 708 and the bottom extensions 709, 710, 711, and 712 may be foldable at the locations where the top extensions 705, 706, 707, 708 and the bottom extensions 709, 710, 711, and 712 abut the walls 701, 702, 703, and 704. The top extensions 705, 706, 707, 708 and the bottom extensions 709, 710, 711, and 712 may be independently movable from one another. The top extensions 705, 706, 707, 708 and the bottom extensions 709, 710, 711, and 712 may be made of the same material as the walls 701, 702, 703, and 704. The top extensions 705, 706, 707, 708 and the bottom extensions 709, 710, 711, and 712 may be made out of a different material than the walls 701, 702, 703, and 704. For example, the walls 701, 702, 703, and 704 may be made of cardboard and one or more of the top extensions 705, 706, 707, 708 and the bottom extensions 709, 710, 711, and 712 may be made out of plastic, corrugated cardboard or plastic, or cardboard coated with a water-resistant or water-proof coating. The entire transformative extender 700 may be coated with a water-proof, water-resistant, or insect-repelling coating. This may be advantageous for preventing weather and insect damage to the extender when in use. The material of the transformative extender 700 may be biodegradable. The transformative extender 700 may be configured to s engage with a waste receptacle 732 such that the transformative extender 700 increases the volume of the waste receptacle 732 into which waste materials may be received. A waste receptacle 732 may be a garbage can, a receptacle, a receptacle for storing waste materials, a container, and the like. A waste receptacle 732 may have a substantially rigid body or a rigid body. A waste receptacle 732 may have a closed bottom. In an exemplary embodiment, waste receptacle 732 has a lid 733.

The transformative extender 700 is not limited to having a first wall 701, a second wall 702, a third wall 703, and a fourth wall 704. For example, the transformative extender 700 may have a single wall such that the interior space 20 is cylindrical in shape. As another example, the transformative extender 700 may have six walls such that the interior space has a hexagonal cross section. Any number of walls is contemplated. Transformative extender 700 is not limited to having a first top extension 705, a second top extension 706, a third top extension 707, and a fourth top extension 708. For example, transformative extender 700 may have a single top extension. Transformative extender 700 is not limited to having a first bottom extension 709, a second bottom extension 710, a third bottom extension 711, and a fourth bottom extension 712. For example, transformative extender 700 may have a single bottom extension. Any number of top extensions and bottom extensions are contemplated.

Figure 22:
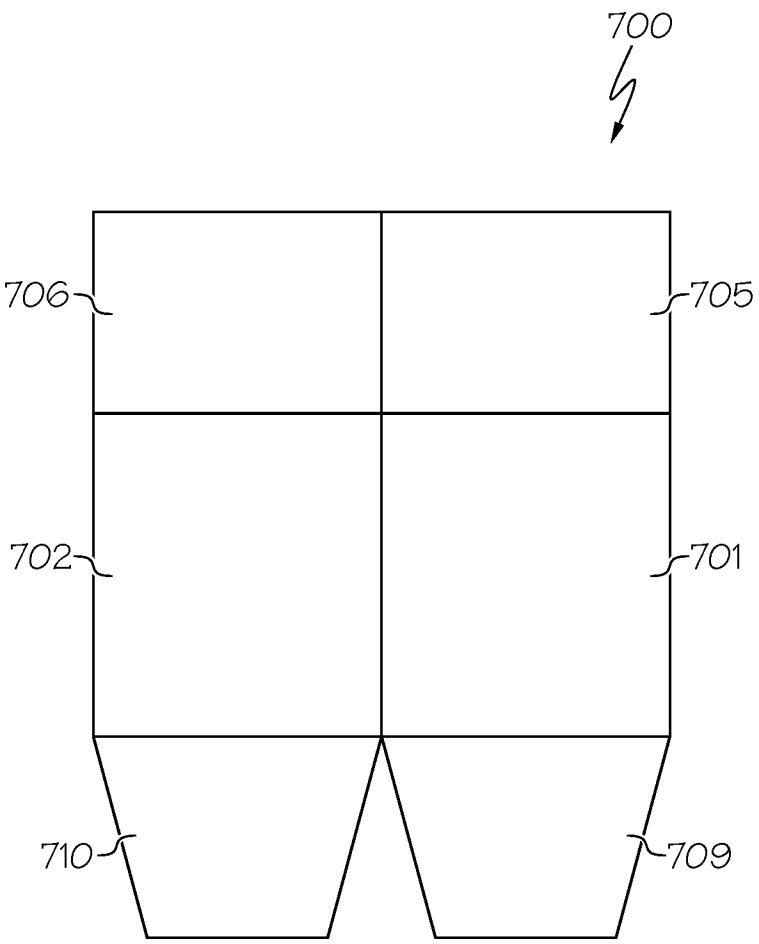
FIG. 22 depicts a front view of an embodiment of a transformative extender in a second pre-assembled flat position.

Referring to FIG. 22, the transformative extender 700 is shown in a second pre-assembled flat position in which the bottom extensions 709, 710, 711, and 712 have been cut such that each bottom extension 709, 710, 711, and 712 has a taper. The taper may begin at each wall 701, 702, 703, and 704, and increase along each bottom extension 709, 710, 711, and 712 extending away from the walls 701, 702, 703, and 704, respectively. The transformative extender 700 may be manufactured such that the bottom extensions 709, 710, 711, and 712 are pre-cut to have tapers. The tapers of the bottom extensions 709, 710, 711, and 712 may be formable along perforations of the bottom extensions 709, 710, 711, and 712. For example, the transformative extender 700 may be manufactured such that the bottom extensions 709, 710, 711, and 712 have perforations such that an end user can create the tapers in the bottom extensions 709, 710, 711, and 712 by removing perforated sections of the bottom extensions 709, 710, 711, and 712. The tapers in the bottom extensions 709, 710, 711, and 712 may be made by folding sections of the bottom extensions 709, 710, 711, and 712. The folding of sections of the bottom extensions 709, 710, 711, and 712 to create tapered shapes thereof may be facilitated by pre-formed perforations in the bottom extensions 709, 710, 711, and 712 that guide the folds such that each of the bottom extensions 709, 710, 711, and 712 have the same tapered shape. The bottom extensions 709, 710, 711, and 712 may have no taper. Further, it should be understood that the bottom extensions 709, 710, 711, and 712 are not limited to the size that is shown in the Figures in relation to the walls 701, 702, 703, and 704. For example, as shown in FIG. 22, each of the bottom extensions 709, 710, 711, 712 have a length extending from a bottom edge where the bottom extensions 709, 710, 711, 712 abut the walls 701, 702, 703, 704, to a bottom extension edge where each bottom extension 709, 710, 711, 712 ends. The lengths of the bottom extensions 709, 710, 711, 712 in FIG. 22 are shown approximately one half the length of the walls 701, 702, 703, and 704. However, the bottom extensions 709, 710, 711, 712 may each have a length that is equal to the lengths of the walls 701, 702, 703, and 704. As another example, one or more bottom extensions 709, 710, 711, 712 may have different lengths.

Figure 23:
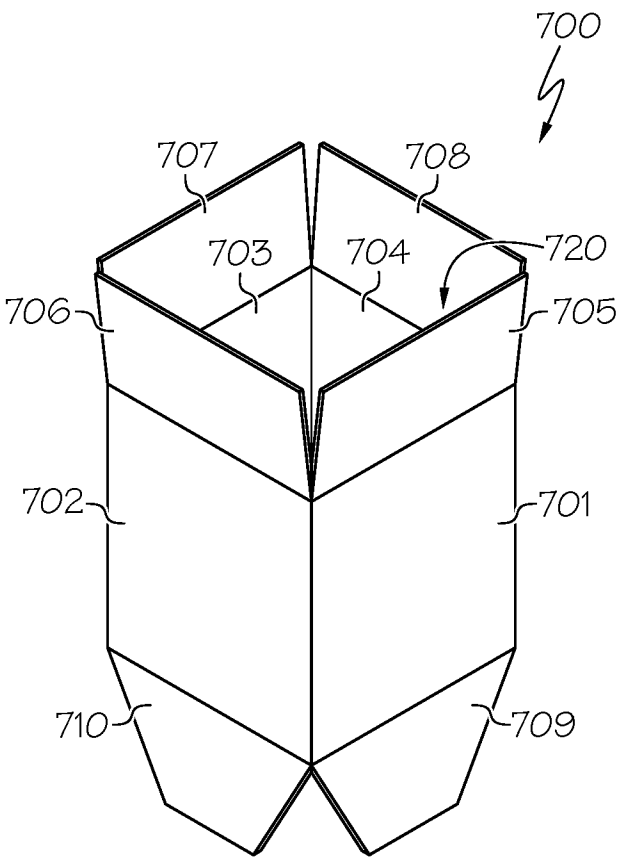
FIG. 23 depicts a perspective view of an embodiment of a transformative extender.

Referring to FIG. 23, a perspective view of an embodiment of transformative extender 700 is shown with walls 701, 702, 703, and 704 defining an interior space 720. The top extensions 705, 706, 707, 708 may be configured to reinforce the extender by providing increased structural support to the transformative extender 700 such that when the transformative extender 700 is inserted into a waste receptacle 732, the placement of additional waste materials into the transformative extender 700 does not weaken the transformative extender 700 or deform the shape of the extender or the walls 701, 702, 703, 704 thereof. This may be accomplished by folding each of the top extensions 705, 706, 707, 708 into the interior space 720 such that the first top extension 705 abuts the first wall 701, the second top extension 706 abuts the second wall 702, the third top extension 707 abuts the third wall 703, and the fourth top extension 708 abuts the fourth wall 704. The positioning of each top extension 705, 706, 707, 708 into the interior space 720 to abut the first wall 701, second wall 702, third wall 703, and fourth wall 704, respectively, may be referred to as reinforcement positions.

Figure 24:
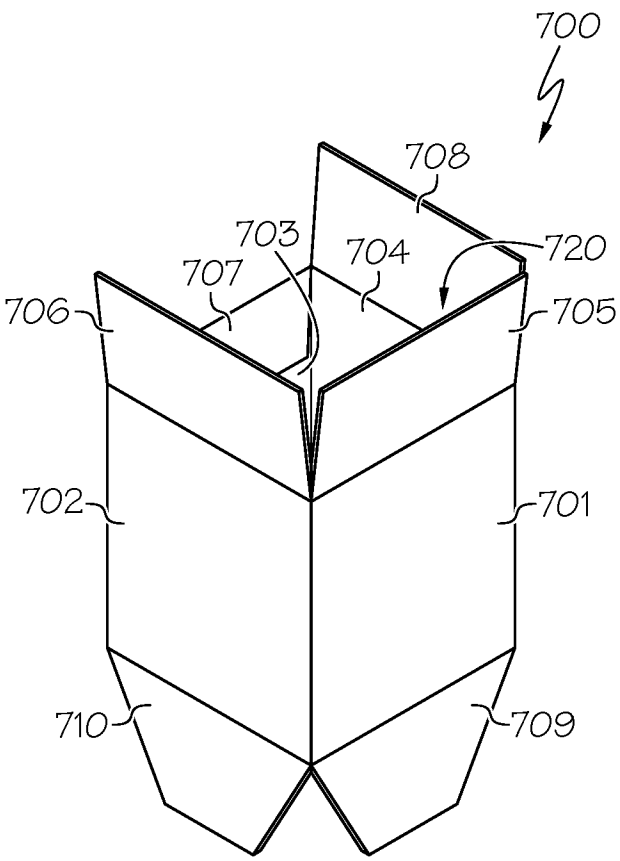
FIG. 24 depicts a perspective view of an embodiment of a transformative extender of FIG. 23 in a first reinforcement position.
Figure 26:
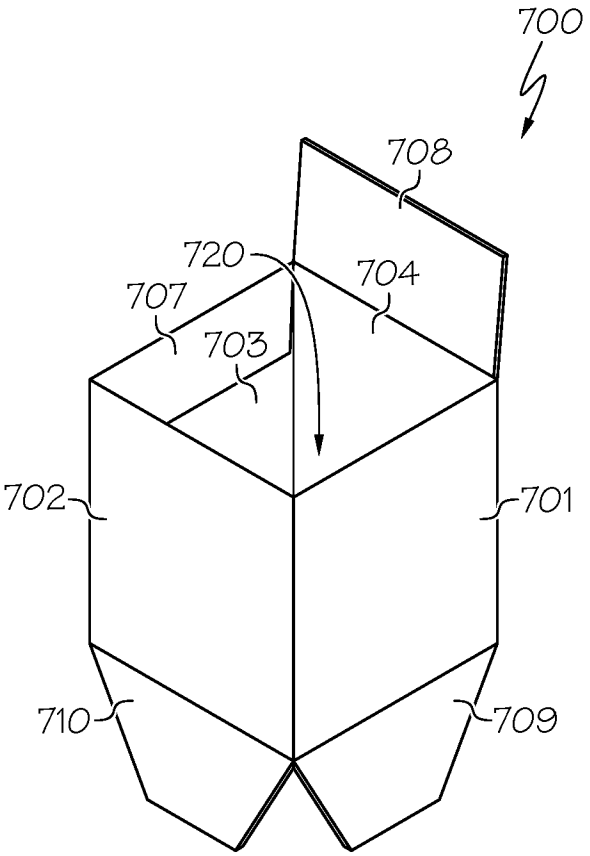
FIG. 26 depicts a perspective view of an embodiment of a transformative extender of FIG. 23 in a third reinforcement position.
Figure 25:
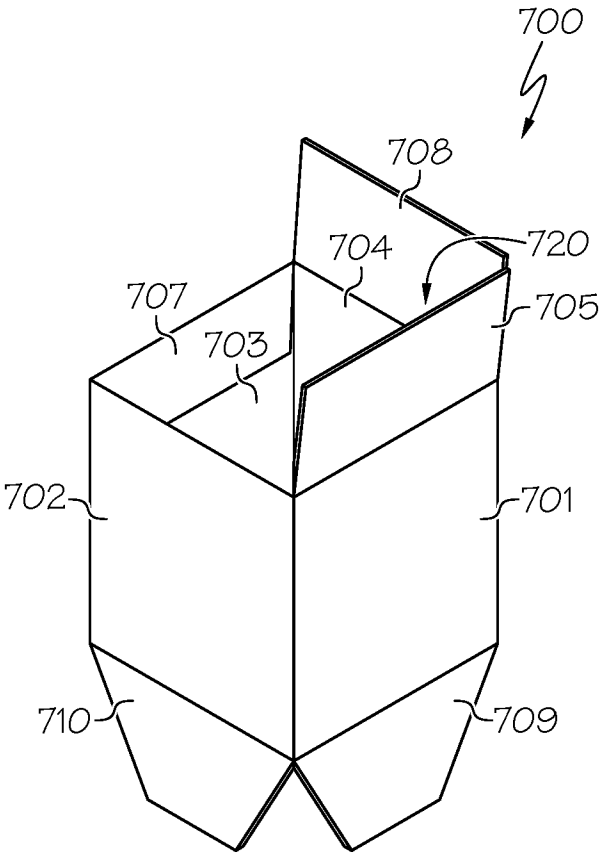
FIG. 25 depicts a perspective view of an embodiment of a transformative extender of FIG. 23 in a second reinforcement position.
Figure 27:
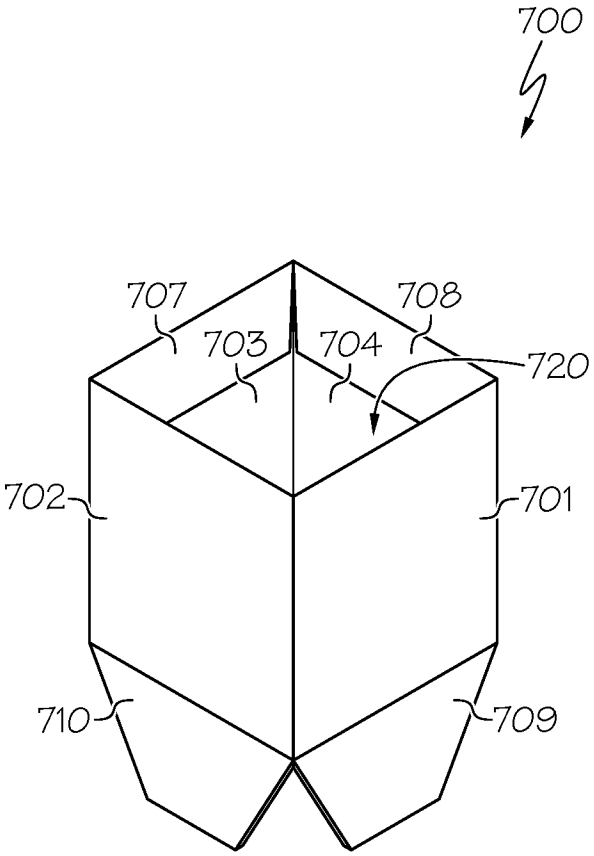
FIG. 27 depicts a perspective view of an embodiment of a transformative extender of FIG. 23 in a fourth reinforcement position.

Referring to FIG. 24, the transformative extender 700 is shown in a first reinforcement position such that the third top extension 707 has been folded into the interior space 720 and abuts the third wall 703. Referring to FIG. 25, the transformative extender 700 is shown in a second reinforcement position such that the second top extension 706 has been folded into the interior space 720 and abuts the second wall 702. Referring to FIG. 26, the transformative extender 700 is shown in a third reinforcement position such that the first top extension 705 has been folded into the interior space 720 and abuts the first wall 701. Referring to FIG. 27, the transformative extender 700 is shown in a fourth reinforcement position such that the fourth top extension 708 has been folded into the interior space 720 and abuts the fourth wall 704. It should be understood that the top extensions 705, 706, 707, 708 are foldable into the interior space 720 to abut the first wall 701, the second wall 702, the third wall 703, and the fourth wall 704, respectively, in any order. If a user requires more storage volume in the transformative extender 700, the top extensions 705, 706, 707, 708 may also be placed in an upright position, and not folded into the interior space. Accordingly, the top extensions 705, 706, 707, 708 may provide additional length to the interior space 720. The top extensions 705, 706, 707, 708 may be configured to secure to one another when in an upright position to provide additional stability to the top extensions 705, 706, 707, and 708 in an upright position.

With continuing reference to FIGS. 23-27, the bottom extensions 709, 710, 711, and 712 are shown having a taper. The bottom extensions 709, 710, 711, and 712 may be configured such that when the transformative extender 700 is inserted into a waste receptacle 732, the bottom extensions 709, 710, 711, and 712 are pressed toward the interior space 20 such that each bottom extension 709, 710, 711, and 712 approaches a position in which each bottom extension 709, 710, 711, and 712 abuts two adjacent bottom extensions of the bottom extensions 709, 710, 711, and 712, thereby forming a taper in a portion of the interior space 720 proximate to the bottom extensions 709, 710, 711, 712.

With continuing reference to FIG. 27, in one embodiment, the transformative extender 700 may comprise a first wall 701 comprising a first top edge, a first bottom edge, a first side edge, and a second side edge; a second wall 702 comprising a second top edge, a second bottom edge, a third side edge, and a fourth side edge; a third wall 703 comprising a third top edge, a third bottom edge, a fifth side edge, and a sixth side edge; a fourth wall 704 comprising a fourth top edge, a fourth bottom edge, a seventh side edge, and an eighth side edge. The first side edge may abut the eighth side edge to form a first corner. The second side edge may abut the third side edge to form a second corner. The fourth side edge may abut the fifth side edge to form a third corner. The sixth side edge may abut the seventh side edge to form a fourth corner. The transformative extender 700 may further comprise a first top extension 705 extending from the first top edge. A width of the first top extension 705 may extend between the first corner and the second corner. The transformative extender 700 may further comprise a second top extension 706 extending from the second top edge. A width of the second top extension 706 may extend between the second corner and the third corner. The transformative extender 700 may further comprise a third top extension 707 extending from the third top edge. A width of the third top extension 707 may extend between the third corner and the fourth corner. The transformative extender 700 may further comprise a fourth top extension 708 extending from the fourth top edge. A width of the fourth top extension 708 may extend between the fourth corner and the first corner. A first bottom extension 709 may extend from the first bottom edge to a first bottom extension edge. The first bottom extension 709 may have a first taper extending from the first bottom edge proximate to the first corner to the first bottom extension edge and a second taper extending from the first bottom edge proximate to the second corner to the first bottom extension edge such that a width of the first bottom extension edge is less than a width of the first bottom edge. A second bottom extension 710 may extend from the second bottom edge to a second bottom extension edge. The second bottom extension 710 may have a third taper extending from the second bottom edge proximate to the second corner to the second bottom extension edge and a fourth taper extending from the second bottom edge proximate to the third corner to the second bottom extension edge such that a width of the second bottom extension edge is less than a width of the second bottom edge. A third bottom extension 711 may extend from the third bottom edge to a third bottom extension edge. The third bottom extension 711 may have a fifth taper extending from the third bottom edge proximate to the third corner to the third bottom extension edge and a sixth taper extending from the third bottom edge proximate to the fourth corner to the third bottom extension edge such that a width of the third bottom extension edge is less than a width of the third bottom edge. A fourth bottom extension 712 may extend from the fourth bottom edge to a fourth bottom extension edge. The fourth bottom extension 712 may have a seventh taper extending from the fourth bottom edge proximate to the fourth corner to the fourth bottom extension edge and a eighth taper extending from the fourth bottom edge proximate to the first corner to the fourth bottom extension edge such that a width of the fourth bottom extension edge is less than a width of the fourth bottom edge. The first wall 701, the second wall 702, the third wall 703, and the fourth wall 704 may define an interior space 720. The first top extension 705 may be folded about the first top edge into the interior space 720 such that the first top extension 705 is parallel to and abuts the first wall 701. The second top extension 706 may be folded about the second top edge into the interior space 720 such that the second top extension 706 is parallel to and abuts the second wall 702. The third top extension 707 may be folded about the third top edge into the interior space 720 such that the third top extension 707 is parallel to and abuts the third wall 703. The fourth top extension 708 may be folded about the fourth top edge into the interior space 720 such that the fourth top extension 708 is parallel to and abuts the fourth wall 704.

Figure 28:
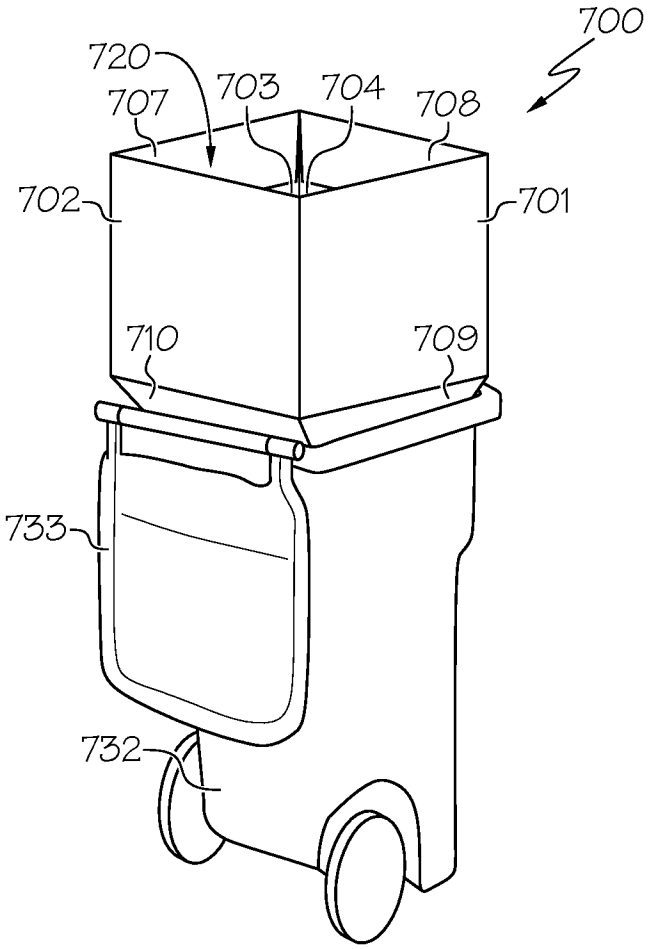
FIG. 28 depicts a perspective view of an embodiment of a transformative extender operably configured with an embodiment of a receptacle.

Referring to FIG. 28, the transformative extender 700 is shown operatively configured with an embodiment of a waste receptacle 732 such that the transformative extender 700 is inserted into the waste receptacle 732. As the transformative extender 700 is inserted further into a waste receptacle 732, the bottom extensions 709, 710, 711, and 712 may press further inward into the interior space until each bottom extension abuts two adjacent bottom extensions of the bottom extensions 709, 710, 711, and 712. For example, the first bottom extension 709 may press inward toward the interior space 720 of the transformative extender 700 when the extender is inserted into a waste receptacle 732 such that the first bottom extension 709 abuts the second bottom extension 710 and the fourth bottom extension 712. The inward pressing of the bottom extensions 709, 710, 711, and 712 as the transformative extender 700 is inserted into a waste receptacle 732 may cause the transformative extender 700 to have a tapered shape such that the interior space 720 proximate to the top extensions 705, 706, 707, and 708 is larger than the interior space 720 proximate to the bottom extensions 709, 710, 711, and 712 formed by a tapered portion of the interior space 720 by the bottom extensions 709, 710, 711, 712. This may permit the transformative extender 700 to be inserted further into a waste receptacle 732, and may also help permit waste materials to be directed into the waste receptacle 732. The taper of the transformative extender 700 caused by the pressing inwards toward the interior space 720 of the bottom extensions 709, 710, 711, and 712 may also permit multiple extenders 700 to be inserted into one another, for example, such that the bottom extensions 709, 710, 711, and 712 of a first transformative extender 700 are inserted into the interior space 720 of a second extender proximate to the top extensions 705, 706, 707, and 708 of the second transformative extender 700. This may be advantageous for directing waste materials into a waste receptacle 732 from a location higher than the waste receptacle 732, such as out of a window of a building. The transformative extender 700 may be configured to disengage or release from the waste receptacle 732 such that the waste materials in the waste receptacle 732 and the waste materials in the transformative extender 700 and the transformative extender 700 can be disposed of. For example, the waste receptacle 732 may be configured to engage with a waste disposal vehicle such that the waste disposal vehicle inverts the waste receptacle 732 and causes the transformative extender 700 to release from the waste receptacle 732 such that the transformative extender 700, the waste materials in the interior space 720 of the transformative extender 700, and the waste materials in the waste receptacle 732 exit the waste receptacle 732 and are disposed of into the waste disposal vehicle.

In an exemplary embodiment, the transformative extender 700 is configurable to transform into a container, for example, a box, such as a moving or storage box. For example, transformative extender 700 may be a box configured to be transformed to include a tapered structure that is configured such that when the transformed box is inserted into the receptacle 732, the tapered structure provides a universal fit such that the transformed box can be inserted into different receptacles having different sizes. The box may comprise a plurality of walls that are configured to enclose an interior space or region 720 of the box. The box may be configured to be transformed to include a reinforcing structure that is foldable into the interior space or region 720 of the box. The reinforcing structure may be configured to form bottom wall 741 of the box. The tapered structure may be configured to form a closable lid of the box, for example, a top wall 740. As an example, in one embodiment, the plurality of walls configured to enclose an interior space or region 720 of the box may be top extensions 705, 706, 707, 708 or bottom extensions 709, 710, 711, 712.

Figure 29:
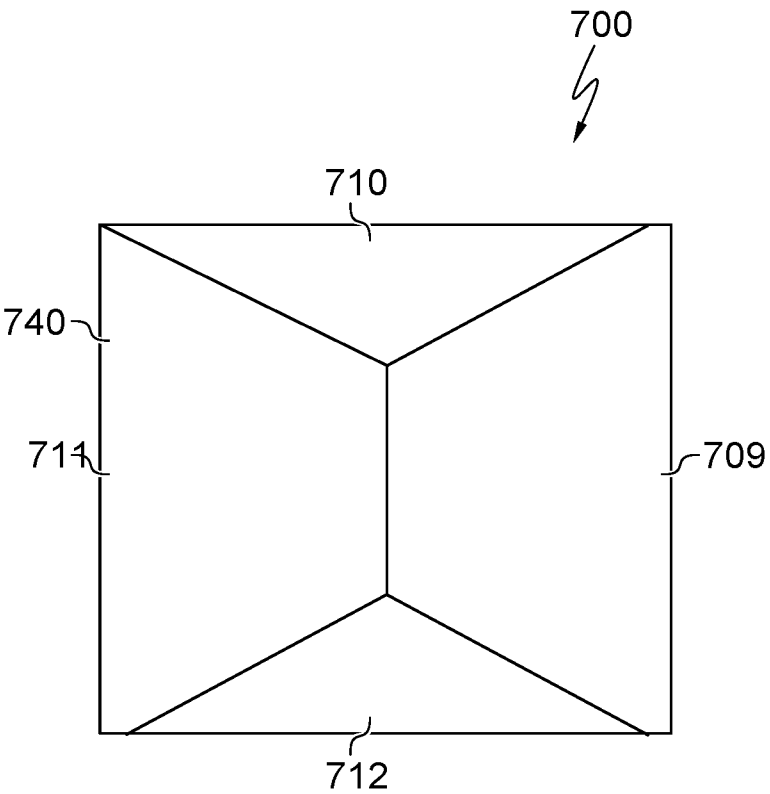
FIG. 29 depicts a top view of an embodiment of a transformative extender in a first closed position.

With reference to FIG. 29, a top view of the transformative extender 700 formed into a container is shown in which the bottom extensions 709, 710, 711, 712 have been folded in a closed position to form an additional wall, for example, top wall 740. This may be accomplished by first folding two of the bottom extensions 709, 710, 711, and 712 to be perpendicular to the walls 701, 702, 703, and 704 and positioned across from one another. For example, the first bottom extension 709 and the third bottom extension 711 may be folded towards one another. The other two bottom extensions such as the second extension 710 and the fourth extension 712 may then be folded towards one another such that the second bottom extension 710 and the fourth bottom extension 712 lay on top of the first bottom extension 709 and the third bottom extension 711. The bottom extensions 709, 710, 711, and 712 may be secured in this position as may be desirable when transporting, shipping, or mailing the transformative extender 700. This may be accomplished by taping the bottom extensions 709, 710, 711, and 712. As another example, the bottom extensions 709, 710, 711, and 712 may be releasably closed by an attachment mechanism such as Velcro® disposed on the bottom extensions 709, 710, 711, and 712, by magnets, glue, buttons, snaps, and the like. The bottom extensions 709, 710, 711, and 712 may be configured to open and close to form top wall 740 multiple times, or may be configured to close for a single use.

It should be understood that the bottom extensions 709, 710, 711, 712 may each have a length that is equal to a length of each wall 701, 702, 703, and 704. In this instance, the top wall 740 of the transformative extender 700 may likewise be formed by folding over each bottom extension 709, 710, 711, 712. For example, the first bottom extension 709 may be folded perpendicular to the walls 701, 702, 703, 704, followed by the third bottom extension 711 being folded over the first bottom extension 709, and then the second bottom extension 710 may be folded over the third bottom extension 711, and finally the fourth bottom extension 712 may be folded over the second extension 710. Any means such as glue, buttons, snaps, magnets, and the like, of securing the bottom extensions 709, 710, 711, 712 in a closed position to form top wall 740 may likewise be employed.

Figure 30:
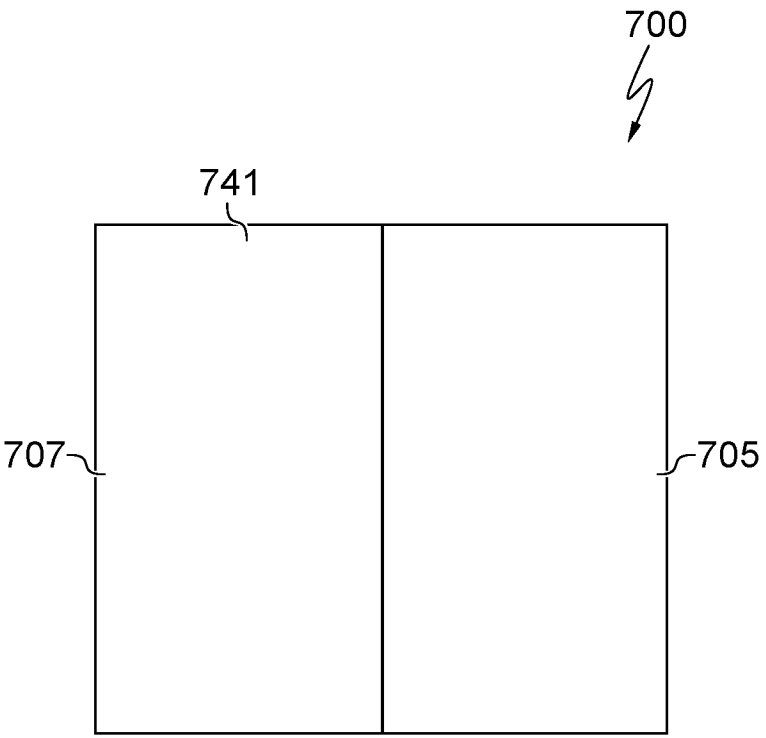
FIG. 30 depicts a bottom view of an embodiment of a transformative extender in a first closed position.

Referring to FIG. 30, a bottom view of the transformative extender 700 formed into a container in a first closed position is shown. For example, the bottom extensions 709, 710, 711, and 712 may be securably closed to create top wall 740, for example, as described above, and the top extensions 705, 706, 707, and 708 may be configured to form an additional wall, for example, bottom wall 741. The transformative extender 700 may thereby be configured to create an enclosed container, such as a box, for example, a moving box or a storage box. For example, as shown in FIG. 30, the top extensions 705, 706, 707, and 708 may be folded inwards such that the interior space 720 is defined further by a bottom wall 741. This may be accomplished by first folding two of the top extensions 705, 706, 707, and 708 that are positioned across from one another, such as the second top extension 706 and the fourth top extension 708 towards one another and then folding the other two top extensions 705, 707 towards one another on top of the second top extension 706 and the fourth top extension 708. The top extensions 705, 706, 707, and 708 may be secured in this position to form a bottom wall 741. This may be accomplished by taping the top extensions 705, 706, 707, and 708. As another example, the top extensions 705, 706, 707, and 708 may be releasably closed by an attachment mechanism such as Velcro® disposed on the top extensions 705, 706, 707, and 708, by magnets, glue, buttons, snaps, and the like. The top extensions 705, 706, 707, and 708 may be configured to open and close to create bottom wall 741 multiple times, or may be configured to close for a single use. It may be particularly advantageous to use the top extensions 705, 706, 707, 708 to form the bottom wall 741 of the transformative extender 700 formed into a container in embodiments in which the top extensions are not tapered. The non-tapered shape of the top extensions 705, 706, 707, 708 in that instance may provide increased stability to the bottom wall 741 for supporting items placed into the transformative extender 700 to be stored, transported, mailed, shipped, and the like.

It should be understood that the top extensions 705, 706, 707, 708 may each have a length that is equal to a length of each wall 701, 702, 703, and 704. In this instance, the bottom wall 741 of the transformative extender 700 may be formed by folding over each top extension 705, 706, 707, 708. For example, the first top extension 705 may be folded perpendicular to the walls 701, 702, 703, 704, followed by the third top extension 707 being folded over the first top extension 705, and then the second top extension 710 may be folded over the third top extension 707, and finally the fourth top extension 708 may be folded over the second top extension 706. Any means such as glue, buttons, snaps, magnets, and the like, of securing the bottom extensions 705, 706, 707, 708 in a closed position to form bottom wall 741 may likewise be employed.

Figure 31:
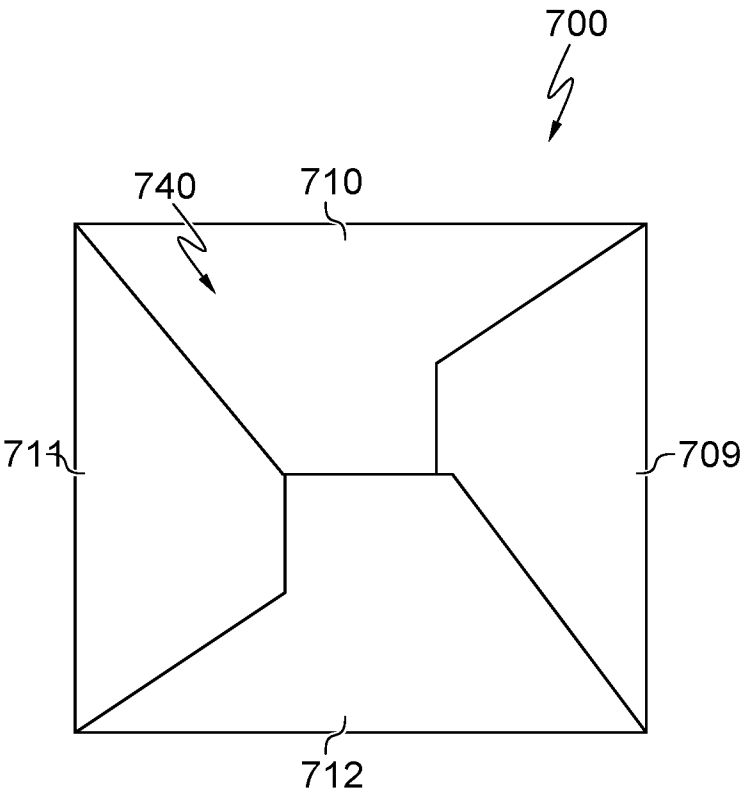
FIG. 31 depicts a top view of an embodiment of a transformative extender in a second closed position.

Referring to FIG. 31, a top view of the transformative extender 700 formed into a container in a second closed position is shown. For example, the bottom extensions 709, 710, 711, and 712 may be configured to be closable to create top wall 740 with or without using tape, Velcro® or other attachment means. For example, bottom extensions 709, 710, 711, and 712 may be folded sequentially such that the first bottom extension 709 is folded inward, the fourth bottom extension 412 is folded inward on top of the first bottom extension 709, the third bottom extension 711 is folded inward on top of the fourth bottom extension 712, and the second bottom extension 710 is folded inward on top of the third bottom extension 711, and a portion of the second bottom extension 710 may be placed underneath a portion of the first bottom extension 709 to secure all the bottom extensions 709, 710, 711, 712 in place.

Figure 32:
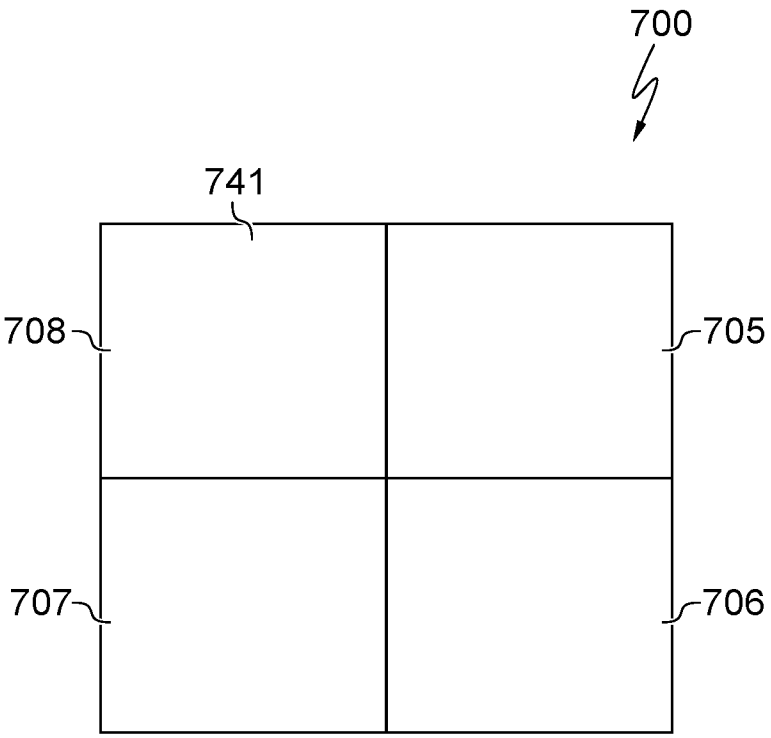
FIG. 32 depicts a bottom view of an embodiment of a transformative extender in a second closed position.

Referring to FIG. 32 a bottom view of the transformative extender 700 formed into a container in a second closed position is shown. For example the top extensions 705, 706, 707, and 708 may be configured to be closable to create top wall 41 with or without using tape, Velcro® or other attachment means. For example, top extensions 705, 706, 707, and 708 may be folded such that the first top extension 705 is folded inward, the fourth top extension 708 is folded inward on top of the first top extension 705, the third top extension 707 is folded inward on top of the fourth top extension 708, and the second top extension 706 is folded inward on top of the third top extension 707, and a portion of the second bottom extension 706 may be placed underneath a portion of the first bottom extension 705 to secure all the top extensions 705, 706, 707, 708 in place. It should be understood that any combination of closed positions of the top extensions 705, 706, 707 and 708, and the bottom extensions 709, 710, 711, and 712 of the transformative extender 700 are contemplated. For example, the top extensions 705, 706, 707, 708, and the bottom extensions 709, 710, 711, 712 may be folded in any order.

As an example of use of the transformative extender 700 according to one embodiment, a user may secure the top extensions 705, 706, 707, 708 to form bottom wall 741 such that the transformative extender 700 is configured to receive objects as a container, place objects into the transformative extender 700 formed into a container, and then secure the bottom extensions 709, 710, 711, and 712 to create top wall 740. A user may then transport, ship, mail, deliver, or otherwise transport the objects in the transformative extender 700 formed into a container. Once at the desired location, the user may then remove the objects after transporting the objects, for example, after moving personal belongings to a new living area. The user may then open the bottom extensions 709, 710, 711, and 712 to be parallel to the walls 701, 702, 703, 704 and thereby transform the bottom wall and then insert the transformative extender 700 into a waste receptacle 732 for further use in placing additional waste materials into the waste receptacle 732.

As another example, the user may use the transformative extender 700 to transport waste materials to a waste receptacle 732. The user may then place the entire transformative extender 700 into the waste receptacle 732. This may be advantageous when a user is cleaning, organizing, or otherwise moving household or other objects around by permitting the user to use the transformative extender 700 as a portable disposable or reusable container. For example, the user may organize unwanted objects such as waste materials into the transformative extender 700, and dispose of the waste materials by inserting the transformative extender 700 into a waste receptacle.

The transformative extender 700 may be inserted into a waste receptacle when formed into a container. Further, the transformative extender 700 may be configured such that the top extensions 705, 706, 707, and 708 are be folded to form bottom wall 741, and the bottom extensions 709, 710, 711, 712 are folded inward into the interior space 720 such that the bottom extensions 709, 710, 711, 712 abut the walls 701, 702, 703, 704. In this configuration, the transformative extender 700 provides a reinforced container.

When using the transformative extender 700 as an extender in a waste receptacle 732, the top extensions 705, 706, 707, 708 may be closed, for example, in the configurations shown in FIGS. 29 and 31, which may be advantageous in preventing waste materials placed in the interior space 730 from becoming wet during weather events, from exuding unpleasant odors, from attracting animals and insects, and to make it easy to move a waste receptacle 732 containing the transformative extender 700 to a desired location without waste materials in the transformative extender 700 from falling out.

Transformative extender 700 may be used for multiple purposes such as packaging, shipping, storage, and the like. For example, a customer may order a product or multiple products from a seller. The seller may use transformative extender 700 to mail or ship the products to the customer by folding the transformative extender 700 into a container, such as a shipping box. This may be accomplished by the seller folding the bottom extensions 709, 710, 711, 712 into a closed position to create bottom wall 740, placing the products into the transformative extender 700 folded into a container, and then closing the top extensions 705, 706, 707, 708 to form top wall 741, thereby enclosing the products. The products may be shipped or mailed to the customer in the transformative extender 700 folded into a container. Upon receipt of the transformative extender 700 folded into a container, the customer may open the top extensions 705, 706, 707, 708 and remove the products. If desired, the customer may then open the bottom extensions 709, 710, 711, 712 and place the transformative extender 700 into a waste receptacle 732 for additional use in disposing of waste materials, such as any packaging materials inside of which the customer's products are delivered. Alternatively, a customer may wish to maintain the container shape of the transformative extender 700 for use in storing the products or other items. It should be understood that the transformative extender may also be sold in its container form, with a user or customer being able to configure the transformative extender 700 into an extender for a waste receptacle 732.

In another embodiment, a transformative extender 700 may be an extender that is formed by providing a single piece of material having a first edge and a second edge; forming, by cutting the single piece of material, at least one top extension extending from at least one wall and at least one bottom extension extending from the at least one wall such that the at least one top extension is foldable to abut the at least one wall; forming, by cutting the at least one bottom extension, a taper in the at least one bottom extension; wherein the at least one bottom extension is configured to create a taper in the interior space when the extender is inserted into a waste receptacle; and attaching the first edge and the second edge together such that the single piece of material defines an interior space.

In another embodiment, the transformative extender 700 may be an apparatus that has a plurality of straight walls 701, 702, 703, 704. The plurality of straight walls 701, 702, 703, 704 may define an interior space 720 between the plurality of straight walls 701, 702, 703, 704. The apparatus may comprise a plurality of tapered walls, for example, bottom extensions 70,5, 706, 707, 708 adjacent to the plurality of straight walls 701, 702, 703, 704, the plurality of tapered walls forming a tapered section of the apparatus that extends inwardly with respect to the plurality of straight walls 701, 702, 703, 704. As another example, the apparatus may comprise a first plurality of walls, wherein the plurality of straight walls defines an interior space between the plurality of straight walls; and a second plurality of walls adjacent to the first plurality of walls, the second plurality of walls forming a tapered section of the apparatus that extends inwardly with respect to the first plurality of walls.

A method for collecting waste materials may comprise a step of providing a receptacle such as waste receptacle 732 for storing waste materials. Another step in a method for collecting waste materials may comprise providing an transformative extender 700, for example, an transformative extender 700 comprising at least one wall, a top extension extending from a top edge of the at least one wall, a bottom extension extending from a bottom edge of the at least one wall, an interior space defined by the at least one wall, wherein the extender is configured to be inserted into a waste receptacle and receive objects into the interior space, wherein the bottom extension has a taper that is configured to press into the interior space when the extender is inserted into a waste receptacle such that the further the extender is inserted into the waste receptacle the interior space is tapered, wherein the bottom extension is releasably closable such that the interior space is further defined by a bottom wall, and wherein the top extension is releasably closable such that the interior space is further defined by a top wall. A method for collecting waste materials may further include disrupting the receptacle such that the extender disengages with the receptacle and exits the receptacle. Disrupting the receptacle may include inverting the receptacle, turning the receptacle on its side, and the like. The transformative extender 700 and receptacle may be configured to be emptied of waste materials in a same motion. Waste materials located within the interior space of the transformative extender 700 may be emptiable without an operator touching the transformative extender 700. A method of collecting waste materials may further comprise providing a replacement extender when the transformative extender 700 is disposed of. A method of collecting waste materials may include inserting the extender into the receptacle after the receptacle and extender have been emptied of waste materials. A method of collecting waste materials may include opening one or more of top extensions 705, 706, 707, and 708.

In another embodiment, a method for collecting waste materials comprises providing a receptacle 732 for storing waste materials. The method may also comprise providing an extender such as transformative extender 700 that has a plurality of walls 701, 702, 703, 704, wherein the plurality of walls 701, 702, 703, 704 defines an interior space 720; a top extension such as top extension 705, 706, 707, 708 extending from the at least one of the plurality of walls 701, 702, 703, 704, wherein the top extension is foldable into the interior space 720 such that the top extension abuts a wall of the plurality of walls 701, 702, 703, 704. The extender may further comprise a bottom extension such as bottom extension 709, 710, 711, 712 extending from the at least one of the plurality of walls 701, 702, 703, 704, wherein the bottom extension is configured to form a taper in a portion of the interior space 720 when the extender 700 is inserted into a waste receptacle 732. The method may also comprise disrupting the receptacle 700 such that the extender disengages with the receptacle 732 and exits the receptacle 732.

Transformative extender 700 may be sold by a municipality for residents to use. Transformative extender 700 may be sold by a garbage collection company in conjunction or independently from a garbage collection service or service plan. Transformative extender 700 may include a bar code that associates the transformative extender 700 with a particular user or customer. This may be advantageous where the transformative extender 700 is configured to be reusable. As another example, the transformative extender 700 may be sold at a retailer, or a moving or shipping company. For example, a retailer that sells a variety of products, or a retailer that sells home improvement tools and supplies may sell transformative extender 700. As another example, a company that provides rental truck or trailer services to customers needing to transport personal belongings to a new home, or business customers needing to move office furniture or office supplies to a new office may sell transformative extender 700 as part of or as an addition to such services, thereby providing enhanced waste disposal capabilities, as well as moving and storage capabilities with a single product: the transformative extender 700.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the invention, as required by the following claims. The claims provide the scope of the coverage of the invention and should not be limited to the specific examples provided herein.

What is claimed is:

1. An apparatus comprising:

a box configured to be transformed to include a tapered structure that provides a universal fit inside a garbage receptacle when the transformed box is inserted into the garbage receptacle, wherein the box includes a plurality of straight walls, a second plurality of walls adjacent to the plurality of straight walls, and a third plurality of walls adjacent to the plurality of straight walls and opposite the second plurality of walls, wherein each wall of the second plurality of walls and the third plurality of walls abuts a straight wall of the plurality of straight walls and extends between a first corner of the straight wall and a second corner of the straight wall, and has a free edge, wherein each wall of the second plurality of walls has a first taper extending from the first corner to the free edge, and a second taper extending from the second corner to the free edge, wherein each first taper and each second taper has a taper angle relative to a straight wall of the plurality of straight walls, wherein each wall of the third plurality of walls has a first side edge extending from the first corner to the free edge and a second side edge extending from the second corner to the free edge, wherein each first side edge and each second side edge has a side edge angle relative to the straight wall of the plurality of straight walls that is different than the taper angle, wherein as the apparatus is inserted into a waste receptacle, each first taper is pressed toward a second taper such that a portion of an interior space of the apparatus has a taper, wherein the second plurality of walls is foldable to form a top or a bottom wall of the box that is perpendicular to and immediately adjacent to the plurality of straight walls, and wherein the third plurality of walls is foldable to form a top or a bottom wall of the box that is perpendicular to and immediately adjacent to the plurality of straight walls.

2. The apparatus of claim 1, wherein the plurality of straight walls, the second plurality of walls, and the third plurality of walls box comprises a plurality of walls are configured to enclose an interior region of the box.

3. The apparatus of claim 1, wherein the box is further configured to be transformed to include a reinforcing structure that is foldable into an interior space of the box.

4. The apparatus of claim 3, wherein the reinforcing structure is configured to form a bottom wall of the box.

5. The apparatus of claim 1, wherein the tapered structure is configured to form a closable lid of the box.

6. A method of making an extender comprising:

cutting a single piece of material having a first edge and a second edge to form at least one top extension extending from at least one wall and at least one bottom extension extending from the at least one wall such that at least one of the at least one top extension and at least one bottom extension is foldable to abut the at least one wall, cutting each of the at least one bottom extension to create a first taper and a second taper in each of the at least one bottom extension, such that each of the at least one bottom extension abuts the at least one wall, extends between a first corner of the at least one wall and a second corner of the at least one wall, and has a free edge, such that the first taper extends from the first corner to the free edge and the second taper extends from the second corner to the free edge, wherein the first taper and second taper each have a taper angle relative to the at least one wall, cutting each of the at least one top extensions such that each of the at least one top extensions extends between a third corner of the at least one wall and a fourth corner of the at least one wall and has a second free edge, a first side edge extending from the third corner to the second free edge, and a second side edge extending from the fourth corner to the second free edge, such that each of the first side edge and second side edge have a side edge angle relative to the at least one wall that is different than the taper angle, wherein the at least one bottom extension is configured to create a taper in a portion of an interior space of the extender when the extender is inserted into a waste receptacle such that as the extender is inserted into a waste receptacle, each first taper is pressed toward a second taper such that a portion of an interior space of the extender has a taper, and attaching the first edge and the second edge together such that the single piece of material defines the interior space, wherein the at least one top extension is foldable to form a top wall or a bottom wall of a box that is perpendicular to and immediately adjacent to the at least one wall, and wherein the at least one bottom extension is foldable to form a top wall or bottom wall of the box that is perpendicular to and immediately adjacent to the at least one wall.

7. An apparatus comprising:

a first plurality of straight walls, wherein the first plurality of straight walls defines an interior space of the apparatus between the first plurality of walls;

a second plurality of walls adjacent to the first plurality of straight walls, wherein each wall of the second plurality of walls abuts an edge of a wall of the first plurality of straight walls, extends between a first corner of the wall of the first plurality of straight walls and a second corner of the wall of the first plurality of straight walls, and has a free edge, wherein each wall of the second plurality of walls has a first taper extending from the first corner to the free edge, and a second taper extending from the second corner to the free edge, wherein the first taper and the second taper each have a taper angle relative to the wall of the first plurality of straight walls, wherein the second plurality of walls is configured to form a tapered section of the apparatus that extends inwardly with respect to the first plurality of walls such that as the extender is inserted further into a waste receptacle, each first taper is pressed towards a second taper such that a portion of a second interior space of the apparatus has a taper; and a third plurality of walls adjacent to the first plurality of straight walls positioned opposite the second plurality of walls, wherein each wall of the third plurality of walls has a second free edge, wherein each wall of the third plurality of walls has a first side edge extending from a third corner of the wall of the first plurality of walls to the second free edge and a second side edge extending from a fourth corner of the wall of the first plurality of walls to the second free edge, wherein the first side edge and the second side edge each have a side edge angle relative to the wall of the first plurality of straight walls that is different than the taper angle, wherein the second plurality of walls is foldable to form a top wall or bottom wall of a box perpendicular to and immediately adjacent to the first plurality of straight walls, wherein the third plurality of walls is foldable to form a top wall or bottom wall of the box perpendicular to and immediately adjacent to the first plurality of straight walls.

8. The apparatus of claim 7, wherein the third plurality of walls is foldable into the interior space such that the third plurality of walls abuts an inner surface of the first plurality of straight walls.

9. The apparatus of claim 8, wherein the third plurality of walls and the second plurality of tapered walls are configured to fold such that the interior space is enclosed by the third plurality of walls and the second plurality of walls.

10. The apparatus of claim 7, wherein the apparatus is recyclable.

11. The apparatus of claim 7, wherein the tapered section is formable along a perforation.

12. The apparatus of claim 7, wherein the apparatus is configured to fold flat.

13. The apparatus of claim 7, wherein the apparatus includes a water-resistant coating.

14. The apparatus of claim 7, wherein the third plurality of walls is configured to be placed in an upright position parallel to the first plurality of straight walls.

15. The apparatus of claim 7, wherein the third plurality of walls is configured to fold to form a bottom wall of the apparatus, and wherein the second plurality of tapered walls is configured to fold to form a top wall of the apparatus to enclose the interior space.

16. A method for collecting waste materials, the method comprising:

providing a receptacle for storing waste materials;

providing a box configured to be transformed to include a tapered structure configured such that when the transformed box is inserted into the receptacle, the tapered structure provides a universal fit, wherein the box includes a plurality of straight walls, a second plurality of walls adjacent to the plurality of straight walls, and a third plurality of walls adjacent to the plurality of straight walls and opposite the second plurality of walls, wherein each wall of the second plurality of walls and the third plurality of walls abuts a straight wall of the plurality of straight walls and extends between a first corner of the straight wall and a second corner of the straight wall, and has a free edge, wherein each wall of the second plurality of walls has a first taper extending from the first corner to the free edge, and a second taper extending from the second corner to the free edge, wherein the first taper and second taper each have a taper angle relative to the straight wall of the plurality of straight walls, wherein each wall of the third plurality of walls has a first side edge extending from the first corner to the free edge and a second side edge extending from the second corner to the free edge, wherein the first side edge and the second side edge each have a side edge angle relative to the straight wall of the plurality of straight walls that is different than the taper angle, wherein as the extender is inserted into a waste receptacle, each first taper is pressed toward a second taper such that a portion of an interior space of the apparatus has a taper, wherein the second plurality of walls is foldable for form a top wall or a bottom wall of the box that is perpendicular to and immediately adjacent to the plurality of straight walls, and wherein the third plurality of walls is foldable for form a top or bottom wall of the box that is perpendicular to and immediately adjacent to the plurality of straight walls; and disrupting the receptacle such that the transformed box disengages with the receptacle and exits the receptacle.

17. The method of claim 16, wherein the box and receptacle are emptied of waste materials in a same motion.

18. The method of claim 16, wherein waste materials located within an interior space of the box are emptied without an operator touching the box.

19. An extender for a waste receptacle comprising:

a first wall comprising a first top edge, a first bottom edge, a first side edge, and a second side edge;

a second wall comprising a second top edge, a second bottom edge, a third side edge, and a fourth side edge;

a third wall comprising a third top edge, a third bottom edge, a fifth side edge, and a sixth side edge;

a fourth wall comprising a fourth top edge, a fourth bottom edge, a seventh side edge, and an eighth side edge;

wherein the first side edge abuts the eighth side edge to form a first corner;

wherein the second side edge abuts the third side edge to form a second corner;

wherein the fourth side edge abuts the fifth side edge to form a third corner;

wherein the sixth side edge abuts the seventh side edge to form a fourth corner;

a rectangular first top extension extending from the first top edge; wherein a width of the first top extension extends between the first corner and the second corner;

a rectangular second top extension extending from the second top edge; wherein a width of the second top extension extends between the second corner and the third corner;

a rectangular third top extension extending from the third top edge; wherein a width of the third top extension extends between the third corner and the fourth corner;

a rectangular fourth top extension extending from the fourth top edge; wherein a width of the fourth top extension extends between the fourth corner and the first corner;

a first bottom extension extending from the first bottom edge to a first bottom extension edge, wherein the first bottom extension has a first taper extending from the first bottom edge proximate to the first corner to the first bottom extension edge and a second taper extending from the first bottom edge proximate to the second corner to the first bottom extension edge such that a width of the first bottom extension edge is less than a width of the first bottom edge;

a second bottom extension extending from the second bottom edge to a second bottom extension edge, wherein the second bottom extension has a third taper extending from the second bottom edge proximate to the second corner to the second bottom extension edge and a fourth taper extending from the second bottom edge proximate to the third corner to the second bottom extension edge such that a width of the second bottom extension edge is less than a width of the second bottom edge;

a third bottom extension extending from the third bottom edge to a third bottom extension edge, wherein the third bottom extension has a fifth taper extending from the third bottom edge proximate to the third corner to the third bottom extension edge and a sixth taper extending from the third bottom edge proximate to the fourth corner to the third bottom extension edge such that a width of the third bottom extension edge is less than a width of the third bottom edge;

a fourth bottom extension extending from the fourth bottom edge to a fourth bottom extension edge, wherein the fourth bottom extension has a seventh taper extending from the fourth bottom edge proximate to the fourth corner to the fourth bottom extension edge and an eighth taper extending from the fourth bottom edge proximate to the first corner to the fourth bottom extension edge such that a width of the fourth bottom extension edge is less than a width of the fourth bottom edge, wherein the first wall, the second wall, the third wall, and the fourth wall define an interior space, wherein at least one of (a) the first through fourth top extensions or (b) the first through fourth bottom extensions are foldable into the interior space such that (a) the at least one of the first through fourth top extensions or (b) the first through fourth bottom extensions are parallel to and abut the first through fourth walls, wherein the first top extension, second top extension, third top extension, and fourth top extension are foldable to form a top or bottom wall of a box perpendicular to and immediately adjacent to the first wall, second wall, third wall, and fourth wall, wherein the first bottom extension, second bottom extension, third bottom extension, and fourth bottom extension are foldable to form a top or bottom wall of the box perpendicular to and immediately adjacent to the first wall, second wall, third wall, and fourth wall, wherein the extender is configured such that as the extender is inserted further into a waste receptacle, each of the first bottom extension, second bottom extension, third bottom extension, and fourth bottom extension are pressed into the interior space such that a portion of the interior space has a taper.

* * * * *